US010131973B2

(12) United States Patent
Hashimura et al.

(10) Patent No.: US 10,131,973 B2
(45) **Date of Patent: *Nov. 20, 2018**

(54) HIGH STRENGTH SPRING STEEL AND STEEL WIRE

(75) Inventors: Masayuki Hashimura, Muroran (JP); Hiroshi Hagiwara, Tokyo (JP); Takanori Miyaki, Muroran (JP); Takayuki Kisu, Muroran (JP); Kouichi Yamazaki, Muroran (JP)

(73) Assignee: NIPPON STEEL & SUMITOMO METAL CORPORATION, Tokyo (JP)

( * ) Notice: Subject to any disclaimer, the term of this patent is extended or adjusted under 35 U.S.C. 154(b) by 987 days.

This patent is subject to a terminal disclaimer.

(21) Appl. No.: 11/630,222

(22) PCT Filed: Nov. 30, 2005

(86) PCT No.: PCT/JP2005/022418

§ 371 (c)(1),
(2), (4) Date: Dec. 19, 2006

(87) PCT Pub. No.: WO2006/059784

PCT Pub. Date: Jun. 8, 2006

(65) Prior Publication Data

US 2008/0279714 A1 Nov. 13, 2008

(30) Foreign Application Priority Data

Nov. 30, 2004 (JP) ..... 2004-346995
Nov. 30, 2004 (JP) ..... 2004-346996

(51) Int. Cl.
*C22C 38/00* (2006.01)
*C22C 38/02* (2006.01)
(Continued)

(52) U.S. Cl.
CPC ..... *C22C 38/04* (2013.01); *C21D 8/06* (2013.01); *C21D 9/525* (2013.01); *C22C 38/001* (2013.01);
(Continued)

(58) Field of Classification Search
CPC ..... C22C 38/001; C22C 38/002; C22C 38/02; C22C 38/04; C22C 38/22; C22C 38/28; C21D 9/525; C21D 8/06
See application file for complete search history.

(56) References Cited

U.S. PATENT DOCUMENTS 4,525,598 A * 6/1985 Tsukamoto et al. ..... 174/128.1
5,776,267 A 7/1998 Shigenobu et al.
(Continued)

FOREIGN PATENT DOCUMENTS

CN 1272890 A 11/2000
CN 1491291 A 4/2004
(Continued)

OTHER PUBLICATIONS

Ofuji (JP 2004-011002), pub. Jan. 2004. (machine translation) (Year: 2004).*
(Continued)

*Primary Examiner* — Keith Walker
*Assistant Examiner* — John A Hevey
(74) *Attorney, Agent, or Firm* — Birch, Stewart, Kolasch & Birch, LLP

(57) ABSTRACT

The present invention provides spring steel used for spring steel wire achieving both high strength and cold coilability and spring steel wire, that is, spring steel containing, by mass %, C: 0.45 to 0.70%, Si: 1.0 to 3.0%, Mn: 0.05 to 2.0%, P: 0.015% or less, S: 0.015% or less, N: 0.0015 to 0.0200%, and t-O: 0.0002 to 0.01 and further limiting Al≤0.01% and Ti≤0.003%. Further, it is characterized by satisfying the
(Continued)

following regarding the cementite-based spherical carbides present at an observed plane, an occupied area ratio of grains with a circle equivalent diameter of 0.2 μm or more of 7% or less, a density of presence of grains with a circle equivalent diameter of 0.2 to 3 μm of $1/\mu m^2$ or less, and a density of presence of grains with a circle equivalent diameter 3 μm or more of $0.001/\mu m^2$ or less, having an prior austenite grain size number of #10 or higher and a residual austenite of 15 mass % or less, and having an area ratio of poor regions with a small density of presence of cementite-based carbides of a circle equivalent diameter of 2 μm or more of 3% or less.

8 Claims, 5 Drawing Sheets

(51) Int. Cl.

| | |
|---|---|
| ***C22C 38/04*** | (2006.01) |
| ***C22C 38/06*** | (2006.01) |
| ***C22C 38/22*** | (2006.01) |
| ***C22C 38/28*** | (2006.01) |
| ***C21D 8/06*** | (2006.01) |
| ***C21D 9/52*** | (2006.01) |

(52) U.S. Cl.
CPC ..... *C22C 38/002* (2013.01); *C22C 38/02* (2013.01); *C22C 38/22* (2013.01); *C22C 38/28* (2013.01)

(56) References Cited

U.S. PATENT DOCUMENTS

| | | | |
|---|---|---|---|
| 6,277,220 | B1 | 8/2001 | Hamada et al. |
| 2003/0201306 | A1 | 10/2003 | McTernan et al. |
| 2004/0112473 | A1 | 6/2004 | Hashimura et al. |

FOREIGN PATENT DOCUMENTS

| | | | | | |
|---|---|---|---|---|---|
| EP | 1 203 829 | | | 5/2002 | |
| EP | 1 347 072 | | | 9/2003 | |
| JP | 57-032353 | | | 2/1982 | |
| JP | 02274837 | A | | 11/1990 | |
| JP | 05009655 | A | | 1/1993 | |
| JP | 05-179348 | | | 7/1993 | |
| JP | 06-158226 | | | 6/1994 | |
| JP | 09-310145 | | | 12/1997 | |
| JP | 10-001746 | | | 1/1998 | |
| JP | 10-121201 | | | 5/1998 | |
| JP | 10-251804 | | | 9/1998 | |
| JP | 2000-169937 | | | 6/2000 | |
| JP | 2001-288539 | | | 10/2001 | |
| JP | 2002-180198 | | | 6/2002 | |
| JP | 2003-105485 | | | 4/2003 | |
| JP | 2003213372 | | * | 7/2003 | |
| JP | 2004-011002 | A | | 1/2004 | |
| JP | 2004011002 | A | * | 1/2004 | ..... C22C 38/00 |
| JP | 2004-143482 | | | 5/2004 | |
| JP | 2005-281860 | A | | 10/2005 | |

OTHER PUBLICATIONS

European Search Report for Application No. EP 05 81 4388, dated Dec. 15, 2009.
European Opposition dated Apr. 15, 2010 issued in corresponding European Application No. 05 81 4388.4.
"Hot Rolled Steels for Quenched and Tempered Springs—Technical Delivery Conditions," British Standard, Ref. No. BS EN 10089:2002, Dec. 2002, pp. 1-35.
Drs. Bläsius, Kinsinger & Valentin, of Saarstahl AG, "Material Technology Developments for Vehicle Supporting Springs," Technical Academy of Esslingen, 2001, pp. 1-6.
Bertrand, et al. "Improving Fatigue Life of Special Steels by Modifying Their Inclusion Engineering," European Commission, Technical Steel Research, Contract No. 7210-PR/04, Jul. 1, 1997 to Jun. 30, 2000, pp. 1-139.
European Search Report dated May 16, 2012, issued in corresponding European Application No. EP 12158986.

* cited by examiner (a)

(b)

(a)

(b)

HIGH STRENGTH SPRING STEEL AND STEEL WIRE

TECHNICAL FIELD

The present invention relates to spring steel used for an engine valve spring or suspension spring, more particularly relates to spring steel and steel wire coiled cold and having a high strength and high toughness.

BACKGROUND ART

Along with the reduction in weight and improvement in performance of automobiles, springs are being made higher in strength. High strength steel having a tensile strength exceeding 1500 MPa after heat treatment is being used for springs. In recent years, steel wire having a tensile strength exceeding 1900 MPa is also being sought. This is so as to secure a hardness of material where even with some softening due to straightening annealing, nitridation, and other heating at the time of spring production, there is no problem for the spring.

Further, it is known that with nitridation or shot peening, the surface hardness rises and the durability during spring fatigue is remarkably improved, but the spring setting characteristic is not determined by the surface hardness. The internal strength or hardness of the spring material also has a great effect. Therefore, it is important to devise ingredients able to maintain the internal hardness extremely high.

As a technique for this, there is an invention adding V, Nb, Mo, or another element, dissolving this by quenching, forming fine carbides precipitated by tempering, and thereby limiting the action of dislocation and improving the anti-setting property (for example, see Japanese Patent Publication (A) No. 57-32353).

On the other hand, among the methods for production of steel coil springs, there are hot coiling of heating the steel to the austenite region for coiling, then quenching and tempering it and cold coiling of quenching and tempering the steel in advance and cold coiling the resultant high strength steel wire. With cold coiling, it is possible to use oil tempering, high frequency treatment, etc. enabling rapid heating and rapid cooling at the time of production of the steel wire, so it is possible to reduce the prior austenite grain size of the spring material. As a result, it is possible to produce a spring superior in breakage characteristics. Further, it is possible to simplify the heating furnace and other facilities on the spring production line, so there is the advantage to the spring manufacturers as well that this leads to a reduction in the capital costs. Recently, cold coiling is being employed even for large diameter suspension springs. In this way, processes are being converted to cold coiling.

However, if the spring-use steel wire for cold coiling increases in strength, it will break at the time of cold coiling and will be unable to be formed into a spring shape in many cases. In this case, both strength and workability cannot be achieved, so the wire has to be coiled by industrially disadvantageous methods. Usually, in the case of a valve spring, steel wire quenched and tempered on-line, so-called oil tempered steel wire, is often cold coiled, but for example there are inventions heating the wire to 900 to 1050° C., coiling it to a spring shape, then tempering it to 425 to 550° C. and otherwise preventing breakage at the time of coiling by heating the wire material, hot coiling it at a temperature where deformation is easy, then thermally refining it to obtain a high strength (for example, see Japanese Patent Publication (A) No. 5-179348). Such heating at the time of coiling and thermal refining after coiling become causes of variations in spring dimensions due to heat treatment and result in a sharp drop in the processing efficiency, so the resultant springs are inferior to cold coiled springs in respect to cost, precision, and product stability.

Further, regarding carbides, for example, there are inventions focusing on the average grain size of the Nb- and V-based carbides. These show that control of the average grain size of the V- and Nb-based carbides alone is insufficient (for example, see Japanese Patent Publication (A) No. 10-251804). In this prior art, it is described that there is a concern over the formation of abnormal structures due to cooling water during rolling. In practice, dry rolling is recommended. This is industrially unstable work and is considered clearly different from the usual rolling. Even if controlling the average grain size, if the surrounding matrix structure becomes uneven, it is suggested that rolling trouble will occur.

Further, there is an invention aiming at improvement of performance by controlling the cementite and other carbides (for example, see Japanese Patent Publication (A) No. 2002-180198).

However, to further improve the fatigue, setting, and other spring performance, further higher strength and spring workability (coilability) have to be secured. There were limits with the ingredients and control of dimensions of the carbides after heat treatment up to now.

In this way, technology for achieving both strength and workability is being searched for. Achievement of both strength and workability has been sought by control of the structure focusing on the cementite-based carbides (Japanese Patent Publication (A) No. 2002-180198). Further, stability is being increased by preventing residual austenite (for example, see Japanese Patent Publication (A) No. 2000-169937). These are largely due to the heat treatment steps. On the other hand, with valve springs, oxides are mainly being controlled. Improvement of fatigue strength by control of oxides is being argued. Oxides are believed to affect not only the fatigue strength itself, but also the stability of the breakage resistance characteristic and product variations. Suppression of the rate of appearance of inclusions at the breakage faces is being sought (for example, see Japanese Patent Publication (A) No. 6-158226).

Further, if not only oxides, but also sulfides, nitrides, carbides, and their composite inclusions are present, the fatigue strength is lowered and a drop in workability is caused. In steel having an extremely high tensile strength such as for valve springs, in Patent Document 6, attempts have been made to control the TiN and further the carbides (for example, see Japanese Patent Publication (A) No. 10-251804), but few technology has considered sulfides as well.

As examples focusing on sulfides, there are ones considering the addition of at least one of Ti, Cu, Ca, and Zr to be effective, but in these examples, the majority concern addition of Ti. Even when not adding Ti, large amounts of Zr, Ca, and other oxide producing elements are added (for example, see Japanese Patent Publication (A) No. 10-1746). If considering one of the characteristic features of the present invention, Zr, since a large amount of 10 ppm or more (in the examples, 70 ppm) is added, there is a large effect on the oxides, the fatigue strength is lowered, the rate of appearance of inclusions rises, or other problems occur.

Further, as other examples, there are ones considering addition of Zr to be effective (for example, see Japanese Patent Publication (A) No. 2003-105485). A large amount of 10 ppm or more (in the examples, 23 ppm) is added, so there is a large effect on the oxides, the fatigue strength is lowered, the rate of appearance of inclusions becomes high, and other problems arise.

Further, there are inventions showing that the amount of addition of Zr should be suppressed to 0.5 ppm or less in solid solution in the steel and clearly indicating that if over this, problems arise due to inclusions (for example, see Japanese Patent Publication (A) No. 9-310145). However, with this amount of addition, control of the sulfides is insufficient. This is easily deduced from the above mentioned Patent Document 8.

DISCLOSURE OF THE INVENTION

The present invention has as its object the provision of spring steel and steel wire used for spring-use steel wire which is coiled cold, can achieve both sufficient strength and coilability, and has a tensile strength of 2000 MPa or more.

The present invention gives spring steel controlling the oxides and sulfides in the steel, something never noted in conventional spring steel wire, by chemical elements so as to achieve both high strength and coilability. Further, the present invention does not just take note of the coarse carbides as seen in steel wire, but discovered that controlling even the microstructure of the matrix is effective and controls the distribution of cementite fine carbides considered necessary up to now for obtaining strength so as to obtain a further higher performance steel wire.

The present invention was made to solve the above problem and has as its gist the following:

(1) Spring steel characterized by containing, by mass %,
C: 0.45 to 0.70%,
Si: 1.0 to 3.0%,
Mn: 0.1 to 2.0%,
P: 0.015% or less,
S: 0.015% or less,
N: 0.0005 to 0.007%, and
t-O: 0.0002 to 0.01%,
comprised of the balance of Fe and unavoidable impurities, and further limited to Al≤0.01% and Ti≤0.003%.

(2) Spring steel as set forth in (1), characterized by further containing Cr: 0.05 to 2.5% and Zr: 0.0001 to 0.0005%.

(3) Spring-use heat treated steel wire comprised of steel as set forth in (1) or (2) which is rolled, drawn, and heat treated, said steel wire satisfying the following regarding the cementite-based spherical carbides and alloy-based carbides present at an observed plane, an occupied area ratio of grains with a circle equivalent diameter of 0.2 μm or more of 7% or less, a density of presence of grains with a circle equivalent diameter of 0.2 to 3 μm of $1/\mu m^2$ or less, and a density of presence of grains with a circle equivalent diameter 3 μm or more of $0.001/\mu m^2$ or less, having an prior austenite grain size number of #10 or higher and a residual austenite of 15 mass % or less, and having an area ratio of poor regions with a small density of presence of cementite-based carbides of a circle equivalent diameter of 2 μm or more of 3% or less.

(4) Spring steel as set forth in (1) or (2), said spring steel further containing, by mass %, one or more of W: 0.05 to 1.0%, Mo: 0.05 to 1.0%, V: 0.05 to 1.0%, Nb: 0.01 to 0.05%, Ni: 0.05 to 3.0%, Co: 0.05 to 3.0%, B: 0.0005 to 0.006%, Cu: 0.05 to 0.5%, Mg: 0.0002 to 0.01%, Ca: 0.0002 to 0.01%, Hf: 0.0002 to 0.01%, Te: 0.0002 to 0.01%, and Sb: 0.0002 to 0.01%.

(5) Spring-use heat treated steel wire as set forth in (3), said spring-use heat treated steel wire characterized by further containing, by mass %, one or more of Cr: 0.05 to 2.5%, W: 0.05 to 1.0%, Zr: 0.0001 to 0.0005%, Mo: 0.05 to 1.0%, V: 0.05 to 1.0%, Nb: 0.01 to 0.05%, Ni: 0.05 to 3.0%, Co: 0.05 to 3.0%, B: 0.0005 to 0.006%, Cu: 0.05 to 0.5%, Mg: 0.0002 to 0.01%, Ca: 0.0002 to 0.01%, Hf: 0.0002 to 0.01%, Te: 0.0002 to 0.01%, and Sb: 0.0002 to 0.01%.

BEST MODE FOR WORKING THE INVENTION

Figure 1:
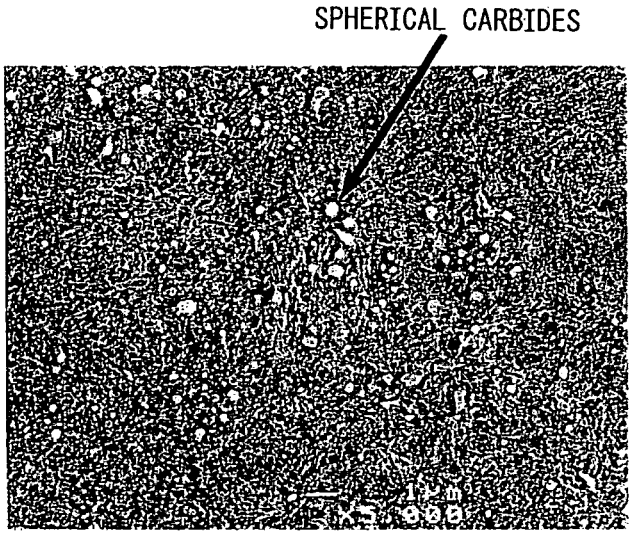
FIG. 1 is a micrograph showing the quenched and tempered structure.

The inventors defined the chemical ingredients for achieving both high strength and workability and further heat treated spring steel able to give good performance so as to control the shapes of the carbides in the steel and thereby invented spring steel wire securing sufficient coilability for production of springs. The details are as follows:

C: 0.45 to 0.70%

C is an element having a large effect on the basic strength of the steel material. To obtain a strength more sufficient than the past, the amount was made 0.45 to 0.7%. If less than 0.45%, a sufficient strength cannot be obtained. In particular even in the case of eliminating the nitridation for improving the spring performance, to secure a sufficient spring strength, 0.50% or more of C is preferable. Further, the content is preferably made 0.6% or more from the viewpoint of the balance of strength and coiling.

Further, there is also a close relationship with the carbide poor regions. If less than 0.45%, there are few carbides, so the area ratio of the poor regions easily increases and sufficient strength and toughness or coilability (ductility) is difficult to obtain. Therefore, the content is preferably 0.5% or more, more preferably 0.6% or more from the viewpoint of the balance of strength and coiling.

Further, there is also an effect on the carbide poor regions. If C forms undissolved carbides in the steel, the amount of substantive C in the matrix falls, so the area ratio of the poor regions sometimes increases as explained above.

On the other hand, if the amount of C increases, the strength after quenching and tempering improves. However, it is known that the form of the martensite at the time of quenching is changed in medium carbon steel from the general lathe martensite to lenticular martensite. The distribution of carbides in the tempered martensite structure of lenticular martensite formed by tempering, compared with that in the case of tempered lath martensite, is lower in carbide density and is aligned in a certain direction, so extreme directionality occurs in the crystals and the structure is brittler compared with a tempered structure of lath martensite. If added over 0.70%, the amount of lenticular martensite and the amount of residual austenite at the time of quenching tend to be become greater, the strength after tempering becomes higher, but the ductility falls, so 0.70% was made the upper limit. Further, if the C dissolving in the heat treatment process is insufficient, local substantive over coprecipitation occurs and a large amount of coarse cementite precipitates, so the toughness is remarkably lowered. This simultaneously lowers the coiling characteristic.

Further, when the amount of C is large, dissolution of alloy-based or cementite-based carbides tends to become difficult. When the heating temperature at the time of heat treatment is low and when the heating time is short, the strength and the coilability are often insufficient. By increasing the amount of C in this way, the increase in the lenticular martensite and undissolved carbides often results in embrittlement.

For this reason, preferably the amount is made 0.68% or less so as to reduce the formation of undissolved carbides and lenticular martensite and the undissolved carbides.

Si: 1.0 to 3.0%

Si is added as a deoxidizing element at the time of steel production and, in spring steel, is an element necessary for securing the spring strength and the hardness and anti-setting characteristic. If less than this, the necessary strength and anti-setting characteristic are insufficient, so 1.0% was made the lower limit. Further, Si has the effect of making the carbide-based precipitates at the grain boundaries spherical and finer. By positively adding this, there is an effect of reducing the occupied area ratio of the grain boundary precipitates at the grain boundaries. However, if added in too large an amount, not only is the material made to harden, but also it is made brittle. Therefore, to prevent embrittlement after quenching and tempering, 3.0% was made the upper limit.

Si is also an element contributing to tempering softening resistance, so to produce a high strength wire material, a large amount is preferably added to a certain extent. Specifically, adding 1.2% or more is preferable. Further, in a high strength spring, the anti-setting characteristic is important, so more preferably 1.6% or more, still more preferably 2.0% or more, is added. On the other hand, to obtain a stable coilability, preferably 2.6% or less is added.

Mn: 0.05 to 2.0%

Mn is frequently used for deoxidation or immobilization of the S in the steel as MnS and improves the quenching ability to obtain sufficient hardness after heat treatment. To secure this stability, 0.05% is made the lower limit. Further, to prevent embrittlement by Mn, the upper limit was made 2.0%. Further, to achieve both strength and coilability, 0.1 to 1.5% is preferable. If considering the effect on carbide poor regions, the amount should be extremely low when suppressing the residual austenite or alloy element segregation. Suppression to less than 0.4%, further 0.3% or less, is preferable. On the other hand, if the diameter of the heat treated steel wire becomes larger, Mn is an effective element to easily impart quenching ability when necessary to secure the quenching ability. When giving priority to this quenching ability, addition over 0.4% is also possible. However, when considering the carbide poor regions and coiling, making the amount 10% or less is effective.

P: 0.015% or less

P causes the steel to harden. Further, it segregates and makes the material brittle. The P segregating at the austenite grain boundaries causes a drop in the impact value and delayed fracture due to entry of hydrogen. For this reason, the smaller the amount the better. Therefore, P was limited to 0.015% or less where the embrittlement tends to become remarkable. Further, in the case of a high strength where the tensile strength of the heat treated steel wire exceeds 2150 MPa, a content of less than 0.01% is preferable.

S: 0.015% or less

S, like P, causes the steel to become brittle when present in steel. Mn reduces its effect sharply, but MnS also takes the form of inclusions, so lowers the breakage characteristic. In particular, in high strength steel, a small amount of MnS sometimes causes breakage. Therefore, it is preferable to reduce the S as much as possible. 0.015%, where this detrimental effect becomes remarkable, was therefore made the upper limit. Further, in the case of a high strength where the tensile strength of the heat treated steel wire exceeds 2150 MPa, the amount is preferably made less than 0.01%.

N: 0.0015 to 0.02%

N hardens the matrix in the steel. It is present as a nitride when Ti, V, or another alloy element is added and has an effect on the properties of the steel wire. In steel to which Ti, Nb, and V has been added, formation of carbonitrides becomes easier. These easily become sites for precipitation of forming carbides, nitrides, and carbonitrides forming pinning grains making the austenite grains finer. For this reason, it is possible to form pinning grains stably under various heat treatment conditions performed before spring production and possible to control the austenite grain size of the steel wire to become finer. For this reason, at least 0.0015% of N is added. On the other hand, excessive N invites increased coarseness of the nitrides and the carbonitrides and carbides formed from the nitrides as nuclei. When adding Ti, V, Nb, and other nitride/carbonitride producing elements, coarse nitrides/carbonitrides are precipitated. If adding B, BN is precipitated etc. causing the breakage resistance characteristic to be impaired. Therefore, the 0.02% not accompanied by such trouble is made the upper limit.

However, N is also an element lowering the hot ductility, so if considering the ease of the heat treatment etc., 0.009% or less is preferable. Further, the lower the lower limit, the better, but if considering the production cost and ease of the denitridation step, 0.0015% or more is preferable. Further, if aiming at making the austenite grain size finer at the time of heat treatment by the pinning effect of V, Nb, etc., it is preferable to add a certain large amount of N. 0.007% or more may also be added.

t-O: 0.0002 to 0.01

Steel contains oxides formed through the deoxidation process and dissolved O. However, if the amount of this oxygen is large, it means that there are many oxide-based inclusions. If the oxide-based inclusions are small in size, they will not affect the spring performance, but if large oxides are present in large quantities, they will have a large effect on the spring performance.

If the total oxygen content (t-O) exceeds 0.01%, the spring performance is remarkably reduced, so the upper limit is made 0.01%. Further, the amount of oxygen should be small, but even if less than 0.0002%, the effect is saturated, so this is made the lower limit. If considering the ease of the actual deoxidation process etc., the content is preferably adjusted to 0.0005 to 0.002%.

W: 0.05 to 1.0%

W precipitates as carbides in the steel. Therefore, if adding one or two types of these elements, these precipitates can be produced and the tempering softening resistance obtained. It brings out high strength without softening even after tempering at a high temperature or heat treatment in straightening annealing, nitridation, etc. in the process. This suppresses the drop in internal hardness of the spring after nitridation and facilitates hot setting or straightening annealing, so improves the final spring fatigue characteristic. However, if the amount of W added is too large, these precipitates become too large and bond with the carbon in the steel to form coarse carbides. This reduces the amount of C contributing to the increase of strength of the steel wire and results in a strength commensurate with the amount of C added no longer being able to be obtained. Further, coarse carbides form sources of stress concentration, so the wire easily breaks due to deformation during coiling. Further, an overcooled structure easily occurs in the process of production of the steel wire, for example, rolling, patenting, and other processes and becomes a cause of cracking or breakage.

Further, W acts to improve the quenching ability and also to form carbides in the steel and improve the strength. Therefore, addition as much as possible is preferable. W has features different from those of other elements and makes the shapes of the carbides containing cementite finer. Further, carbonitrides of W are only formed at lower temperatures than Ti, Nb, etc., so W itself seldom remains as undissolved carbides.

Further, there is also the effect of suppressing the growth of carbides formed by V and other elements easily resulting in residual undissolved carbides and suppressing the dimensions of the undissolved carbides.

Further, precipitation hardening enables tempering softening resistance to be imparted. That is, even in nitridation and straightening annealing, the internal hardness will not be caused to decline much. If the amount of addition is 0.05% or less, no effect is seen, while if over 1.0%, coarse carbides are formed and conversely the ductility and other mechanical properties are liable to be impaired, so the amount of addition of W was made 0.05 to 1.0%. Further, if considering the ease of heat treatment etc., 0.1 to 0.5% is preferable. If considering the balance with strength, 0.16 to 0.35% or so is further preferable.

Cr: 0.05 to 2.5%

Cr is an effective element for improving the quenching ability and the tempering softening resistance, but if the amount of addition is large, not only is an increase in cost incurred, but also the cementite seen after the quenching and tempering is made coarser. As a result, the wire material becomes brittle, so easily breaks at the time of coiling. Therefore, to secure the quenching ability and the tempering softening resistance, 0.05% was made the lower limit and 2.5%, where the embrittlement becomes remarkable, was made the upper limit.

Cr obstructs the melting of the cementite by heating, so if the amount of C becomes a large, such as C>0.55%, suppressing the amount of Cr enables the formation of coarse carbides to be suppressed and both strength and coilability to be easily achieved. Therefore, preferably the amount of addition is made 2.0% or less. More preferably, it is made 1.7% or so.

On the other hand, when performing nitridation, addition of Cr enables the nitridation hardened layer to be made deeper. Therefore, addition of 0.7% or more is preferable. Further, when imparting hardness by nitridation and softening resistance at the nitridation temperature, addition of over 1.0% is preferable. When a particularly high strength and setting characteristic are required, addition of 1.2% or more is preferable. Further, if a large amount of Cr is added, it becomes a cause of an overcooled structure in the production process of steel wire and cementite-based spherical carbides easily remain, so if considering the ease of heat treatment, 2.0% or less is preferable.

Zr: 0.0001 to 0.0005%

Zr is an oxide and sulfide producing element. Oxides are finely dispersed in the spring steel, so like Mg, form nuclei for precipitation of MnS. Due to this, the fatigue durability is improved and the ductility is increased to improve the coilability. If less than 0.0001%, this effect is not seen. Further, even if added over 0.0005%, formation of hard oxides is promoted, so even if the sulfides finely disperse, trouble due to oxides easily occurs. Further, with large addition, not only oxides, but also ZrN, ZrS, and other nitrides and sulfides are formed and cause trouble in production or a drop in the fatique durability property of the spring, so the amount was made 0.0005% or less. Further, when using this for a high strength spring, the amount of addition is preferably made 0.0003% or less. These elements are small in amount, but can be controlled by careful selection of the secondary materials and precisely controlling the refractories etc.

For example, if making liberal use of Zr refractories in locations in contact with molten steel for a long time such as the ladle, tundish, nozzle, etc., it is possible to add 1 ppm or so with respect to 200 tons or so of molten steel. Further, while considering this, it is possible to consider this and add secondary materials so as not to exceed a prescribed range. The method of analysis of Zr in the steel is to sample 2 g from the part of the steel material being measured free from the effect of surface scale, treat the sample by the same method as in Attachment 3 of JIS G 1237-1997, then measure it by ICP. At this time, the calibration line in ICP is set to be suitable for the fine amount of Zr.

Al≤0.01%

Al is a deoxidizing element and has an effect on formation of oxides. If carelessly added to facilitate the formation of hard oxides, hard carbides will be produced and lower the fatigue durability. In particular, in high strength spring, lowering the variation and stability of the fatigue strength from the fatigue limit of the spring and limiting the amount of Al, since if the amount is too large, the rate of breakage due to inclusions becomes greater, is being demanded from the users. Further, from the viewpoint of control of the sulfides, Zr is added to make the sulfides finely disperse and spherical. If the amount of Al is too great, this effect is impaired. Therefore, from this viewpoint, addition of a large amount is not preferable. For this reason, in a steel material for a high strength spring, the content has to be suppressed more than the past, so the content is limited to 0.01% or less (including 0%). When requiring further higher fatigue strength, making the content 0.002% or less is preferable.

Ti≤0.003%

Ti is a deoxidizing element and a nitride and sulfide producing element, so has an effect on the production of oxides and nitrides and sulfides. Addition of a large amount facilitates the formation of hard oxides and nitrides, so if carelessly added, hard carbides will be formed and the fatigue durability will be reduced. In the same way as Al, in particular in a high strength spring, the amount is limited to 0.003% or less (including 0%) to lower the variation and stability of the fatigue strength from the fatigue limit of the spring and since if the amount of Ti is too large, the rate of breakage due to inclusions becomes greater. Further, from the viewpoint of control of the sulfides, Zr is added to make the sulfides finely disperse and spherical. If the amount of Ti is too great, this effect is impaired. Therefore, from this viewpoint, addition of a large amount is not preferable. For this reason, in a steel material for high strength spring, the content has to be suppressed more than the past, so 0.003% was made the upper limit. Further, when a high fatigue strength is required, a content of 0.002% or less is preferable.

Mo: 0.05 to 1.0%

Mo precipitates as carbides at a temperature of about the tempering or nitridation temperature. By forming these precipitates, tempering softening resistance can be obtained. It brings out high strength without softening even after tempering at a high temperature or heat treatment in straightening annealing, nitridation, etc. in the process. This suppresses the drop in internal hardness of the spring after nitridation and facilitates hot setting or straightening annealing, so improves the final spring fatigue characteristic. However, these precipitates become too large and bond with the carbon in the steel to form coarse carbides. This reduces the amount of C contributing to the increase of strength of the steel wire and results in a strength commensurate with the amount of C added no longer being able to be obtained. Further, coarse carbides form sources of stress concentration, so the wire easily breaks due to deformation during coiling. Further, addition of Mo improves the quenching ability and can impart tempering softening resistance. That is, it is possible to increase the tempering temperature at the time of controlling the strength. This point is advantageous for reducing the occupied area ratio of grain boundary carbides at the grain boundaries. That is, by tempering the grain boundary carbides precipitating in a film state at a high temperature, there is the effect of making them spherical and reducing the grain boundary area ratio. Further, Mo forms Mo-based carbides separate from cementite in the steel. In particular, it has a lower precipitation temperature than with V etc., so has the effect of suppressing the coarsening of the carbides. With an amount of addition of 0.05% or less, no such effect is recognized. However, if the amount of addition is large, an overcooling structure is easily formed due to rolling or softening heat treatment before drawing. This easily causes cracking and wire breakage at the time of drawing. That is, at the time of drawing, the steel material is preferably patented to obtain a ferrite-pearlite structure, then is drawn.

Mo is an element imparting a large quenching ability, so if increasing the amount of addition, the time until the end of the pearlite transformation becomes longer. At the time of cooling after rolling or in the patenting process, an overcooled structure is easily formed which becomes a cause of breakage at the time of drawing. When not breaking and present as internal cracks, this causes the final product to greatly deteriorate. If Mo exceeds 1.0%, the quenching ability becomes larger and industrially obtaining a ferrite-pearlite structure becomes difficult, so this is made the upper limit. To suppress the formation of a martensite structure, which lowers the production ability in the rolling, drawing, or other production processes, and facilitate industrially stable rolling and drawing, a content of 0.4% or less is preferable, and 0.2% is more preferable.

V: 0.05 to 1.0%

V can be used to suppress the coarsening of the austenite grains due to formation of nitrides, carbides, and carbonitrides and also to harden the steel wire at the tempering temperature and harden the surface at the time of nitridation. If the amount of addition is 0.05% or less, almost no effect of addition can be recognized. Further, large addition forms coarse undissolved inclusions and reduces the toughness. Like Mo, it easily forms an overcooled structure which easily causes cracking or breakage at the time of drawing. For this reason, the 1.0% where industrially stable handling is easy was made the upper limit. V nitrides, carbides, and carbonitrides are also formed at the steel austenitization temperature $A_3$ point or more, so if they insufficiently dissolve, they easily remain as undissolved carbides (nitrides). Therefore, industrially the amount is preferably made 0.5% or less, more preferably 0.2% or less.

Nb: 0.01 to 0.05%

Nb can be used to suppress the coarsening of the austenite grains due to formation of nitrides, carbides, and carbonitrides and also to harden the steel wire at the tempering temperature and harden the surface at the time of nitridation. If the amount of addition is 0.01% or less, almost no effect of addition can be recognized. Further, large addition forms coarse undissolved inclusions and reduces the toughness. Like Mo, it easily forms an overcooled structure which easily causes cracking or breakage at the time of drawing. For this reason, the 0.05% where industrially stable handling is easy was made the upper limit. Nb nitrides, carbides, and carbonitrides are also formed at the steel austenitization temperature $A_3$ point or more, so if they insufficiently dissolve, they easily remain as undissolved carbides (nitrides). Therefore, industrially the amount is preferably made 0.04% or less, more preferably 0.03% or less.

Ni: 0.05 to 3.0%

Ni can improve the quenching ability and stably increase the strength by heat treatment. Further, it can improve the ductility of the matrix and improve the coilability. However, with quenching and tempering, it increases the residual austenite, so the material is inferior in terms of setting of spring formation or uniformity of the material. If the amount of addition is 0.05% or less, no effect can be recognized in increasing the strength and improving the ductility. On the other hand, addition of a large amount of Ni is not preferable. At 3.0% or more, problems such as an increase in residual austenite becomes remarkable, the effect of improvement of the quenching ability and improvement of the ductility become saturated, and there are cost disadvantages etc.

Co: 0.05 to 3.0%

Co reduces the quenching ability in some cases, but improves the high temperature strength. Further, to inhibit the growth of carbides, it acts to suppress the formation of coarse carbides which become a problem in the present invention. Therefore, it is possible to suppress the coarsening of the carbides including cementite. Therefore, addition is preferable. When added, if 0.05% or less, the effect is small. However, if added in a large amount, the ferrite phase increases in hardness and reduces the ductility, so the upper limit was made 3.0%.

B: 0.0005 to 0.006%

B is an element improving the quenching ability and has an effect of cleaning the austenite grain boundaries. The addition of B renders harmless the P, S, and other elements segregating at the grain boundary and reducing the toughness and therefore improves the breakage characteristics. At this time, the effect is lost if the B bonds with N and forms BN. The lower limit of the amount of addition is made 0.0005% where the effect becomes clear, while the upper limit is made 0.0060% where the effect becomes saturated.

However, if even a little amount of BN is produced, it causes embrittlement, so full consideration is required so as to not produce BN. Therefore, preferably the amount is 0.003 or less. More preferably, it is effective to immobilize the free N by the Ti or other nitride producing elements and make the amount of B 0.0010 to 0.0020%.

Cu: 0.05 to 0.5%

Regarding Cu, Cu can be added to prevent decarburization. A decarburized layer causes a drop in the fatigue life after spring working, so effort is made to reduce this as much as possible. Further, when the decarburized layer becomes deep, the surface is removed by peeling. Further, like Ni, it has the effect of improving the corrosion resistance. By suppressing the decarburized layer, it is possible to improve the fatigue life of the spring and eliminate the peeling step. The effect of Cu in suppressing decarburization and the effect in improving the corrosion resistance can be exhibited when 0.05% or more. As explained later, even if adding Ni, if over 0.5%, embrittlement easily causes rolling flaws@. Therefore, the lower limit was made 0.05% and the upper limit was made 0.5%. The addition of Cu does not detract much at all from the mechanical properties at room temperature, but even if adding Cu over 0.3%, the hot ductility is degraded, so sometimes the billet surface cracks during rolling. For this reason, the amount of addition of Ni for preventing cracking during rolling is preferably made [Cu %]<[Ni %] in accordance with the amount of addition of Cu. In the range of Cu of 0.3% or less, rolling flaws are not caused, so it is not necessary to limit the amount of addition of Ni for the purpose of preventing rolling flaws.

Mg: 0.0001 to 0.01%

Mg produces oxides in molten steel of a temperature higher than the MnS formation temperature. These are already present in the molten steel at the time of MnS formation. Therefore, they can be used as nuclei for precipitation of MnS. Due to this, the distribution of MnS can be controlled. Further, looking at the number distribution as well, Mg-based oxides are dispersed in the molten steel more finely than the Si- and Al-based oxides often seen in conventional steel, so the MnS precipitated using the Mg-based oxides as nuclei finely disperses in the steel. Therefore, even with the same S content, the distribution of MnS differs depending on the presence or absence of Mg. Addition of these results in a finer MnS grain size. This effect is sufficiently obtained even in a small amount. If Mg is added, MnS is made finer. However, if exceeding 0.0005%, not only are hard oxides easily formed, but also MgS and other sulfides start to be formed so a drop in the fatigue strength and a drop in the coilability are invited. Therefore, the amount of addition of Mg was made 0.0001 to 0.01%. When used for a high strength spring, an amount of 0.0003% or less is preferable. The amount of the element is small, but about 0.0001% can be added by making liberal use of Mg-based refractories. Further, Mg may be added by carefully selecting the secondary materials and using secondary materials with small Mg contents. Further, when used for high strength valve springs, the susceptibility to inclusions is high, so the content is preferably suppressed to a small amount of 0.001% or less, more preferably 0.0005% or less. This Mg has an effect on the distribution of the MnS. Due to this, there is an effect on the improvement of the corrosion resistance and delay fracture and prevention of rolling cracking. It is preferable to add this as much as possible, so control of the amount of addition in the extremely narrow range of 0.0002 to 0.0005% is preferable.

Ca: 0.0002 to 0.01%

Ca is an oxide and sulfide producing element. In spring steel, by making MnS spherical, the length of MnS, which serves as a starting point of fatigue and other breakage, can be suppressed to make it harmless. The effect becomes unclear if less than 0.0002%. Further, even if added over 0.01%, not only is the yield poor, but also oxides or CaS or other sulfides are produced and cause trouble in production or a drop in the fatique durability property of the spring, so the amount was made not more than 0.01%. The amount of addition is preferably not more than 0.001%.

Hf: 0.0002 to 0.01%

Hf is an oxide producing element and forms the nuclei of precipitation of MnS. For this reason, it is an element producing oxides and sulfides by fine dispersion. In spring steel, the oxides are finely dispersed, so like Mg, form nuclei of precipitation of MnS. Due to this, the fatigue durability is improved and the ductility is increased to improve the coilability. This effect is not clear if the amount is less than 0.0002%. Further, even if over 0.01% is added, the yield is poor. Not only this, but also oxides or ZrN, ZrS, or other nitrides and sulfides are produced and cause production trouble or a drop in the fatique durability property of the spring, so the amount was made 0.01% or less. This amount of addition is preferably 0.003% or less.

Te: 0.0002 to 0.01%

Te has the effect of making MnS spherical. If less than 0.0002%, the effect is not clear, while if over 0.01%, the matrix falls in toughness, hot cracking occurs, the fatigue durability is reduced, and other remarkable problems occur, so 0.01% is made the upper limit.

Sb: 0.0002 to 0.01%

Sb has the effect of making MnS spherical. If less than 0.0002%, the effect is not clear, while if over 0.01%, the matrix falls in toughness, hot cracking occurs, the fatigue durability is reduced, and other remarkable problems occur, so 0.01% is made the upper limit.

Note that the steel produced by such ingredients has nonmetallic inclusions including sulfides of a form suitable for spring steel and the effects can be reduced.

Tensile Strength 2000 MPa or More

If the tensile strength is high, the fatigue strength of the spring tends to improve. Further, even with nitridation or other surface hardening treatment, if the basic strength of the steel wire is high, a further higher fatigue characteristic or setting characteristic can be obtained. On the other hand, if the strength is high, the coilability falls and spring production becomes difficult. For this reason, it is important to not only increase the strength, but also simultaneously impart ductility enabling coiling.

Note that in use as a spring, not only the fatigue durability, but also the setting is important. A heat treated material often has a tensile strength of 2000 MPa or more so that the setting characteristic is good even at a high load. Further, in the case of nitridation, it is necessary that the steel not greatly soften even if exposed to the 500° C. temperature of the nitridation conditions, i.e., that so-called tempering softening resistance be imparted. On the other hand, increasing the strength causes the coilability to drop, so ingredients achieving both tempering softening resistance and coilability are required. From this, it is desirable to use chemical ingredients enabling this and give the high strength spring steel wire a tensile strength of 2250 MPa, more preferably 2300 MPa or more. For this reason, the present invention defines chemical ingredients assuming achieving both high strength and high workability after heat treatment.

Undissolved Carbides

To obtain a high strength, C and Mn, Ti, V, Nb, and other so-called alloy elements are added. Among these, when adding large amounts of elements forming nitrides, carbides, and carbonitrides, undissolved carbides easily remain. The "undissolved carbides" referred to here include not only so-called alloy-based carbides of the above alloys forming nitrides, carbides, and carbonitrides, but also cementite-based carbides having Fe carbides (cementite) as their main ingredients. Further, alloy-based carbides also strictly speaking often become composite carbides with nitrides (so-called "carbonitrides"), so here these alloy-based carbides, nitrides, and their composite alloy-based precipitates will be referred to all together as "alloy-based carbides".

These carbides may be mirror polished and etched for observation. Further, the replica method of a transmission electron microscope may also be used to observe the carbonitrides. These undissolved carbides, that is, carbonitrides, and nitrides are sufficiently dissolved at the time of heating, so often appear spherical and cause a sharp drop in the mechanical properties of the steel wire.

FIG. 1 shows a typical example of observation. According to this, two types of forms, a matrix needle-shaped structure and spherical structure, are recognized in the steel. In general, it is known that steel forms a martensite needle shaped structure by quenching and forms carbides by tempering so both strength and toughness can be achieved. However, in the present invention, as shown in FIG. 1, note is taken that not only needle shaped structures, but also spherical structures remain in large numbers. These spherical structures are undissolved carbides. The inventors discovered that their distribution has a large effect on the performance of spring-use steel wire. These spherical carbides are believed to be carbides which do not sufficiently dissolve at the time of the oil tempering or the high frequency treatment quenching and tempering and become spherical and grow or shrink in the quenching and tempering process. Carbides of these dimensions do not contribute at all to the strength and toughness through quenching and tempering. For this reason, not only is the C in the steel immobilized and the added C wasted, but also the C becomes sources of stress concentration, so becomes a cause of reduction of the mechanical properties of the steel wire.

Therefore, the spherical carbides at the observed plane are also limited as follows. The following limitations are important for eliminating the problems due to these:

an occupied area ratio of grains with a circle equivalent diameter of 0.2 μm or more of 7% or less, a density of presence of grains with a circle equivalent diameter of 0.2 to 3 μm of $1/\mu m^2$ or less, and a density of presence of grains with a circle equivalent diameter 3 μm or more of $0.001/\mu m^2$ or less, When quenching and tempering steel, then cold coiling it, the carbides have an effect on the coiling characteristics, that is, they have an effect on the bending characteristics until breakage. Up until now, to obtain a high strength, the general practice had been to add not only C, but also large amounts of Cr, V, and other alloy elements, but there was the problem that the strength became too high and the deformability become insufficient and the coiling characteristic was deteriorate. As the cause, the coarse carbides precipitated in the steel may be considered.

Figure 2:
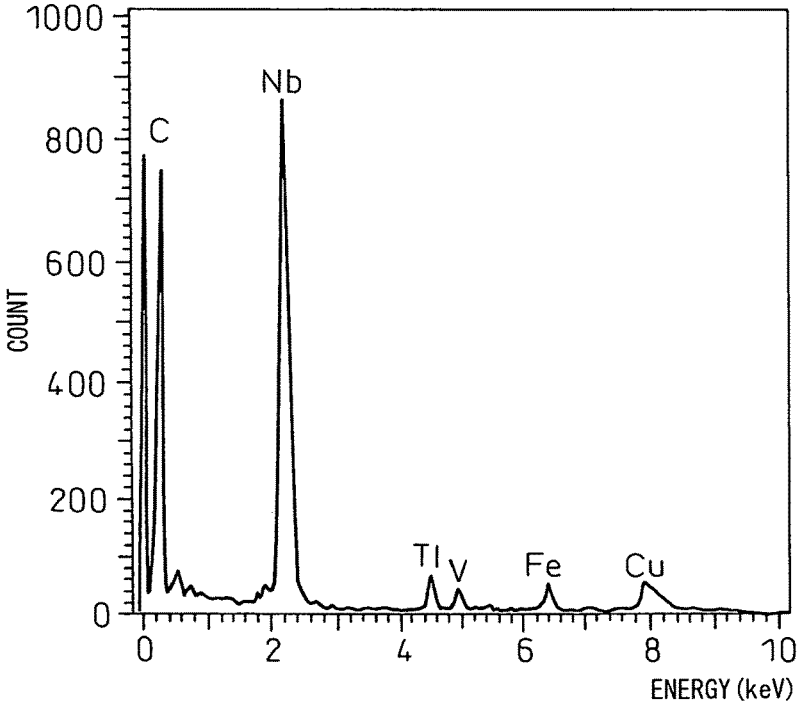
FIG. 2 shows graphs of examples of analysis by an EDX mounted on an SEM, wherein (a) is a graph of an example of analysis of spherical carbides (alloy-based) and (b) is a graph of an example of analysis of spherical carbides (cementite-based).
Figure 2:
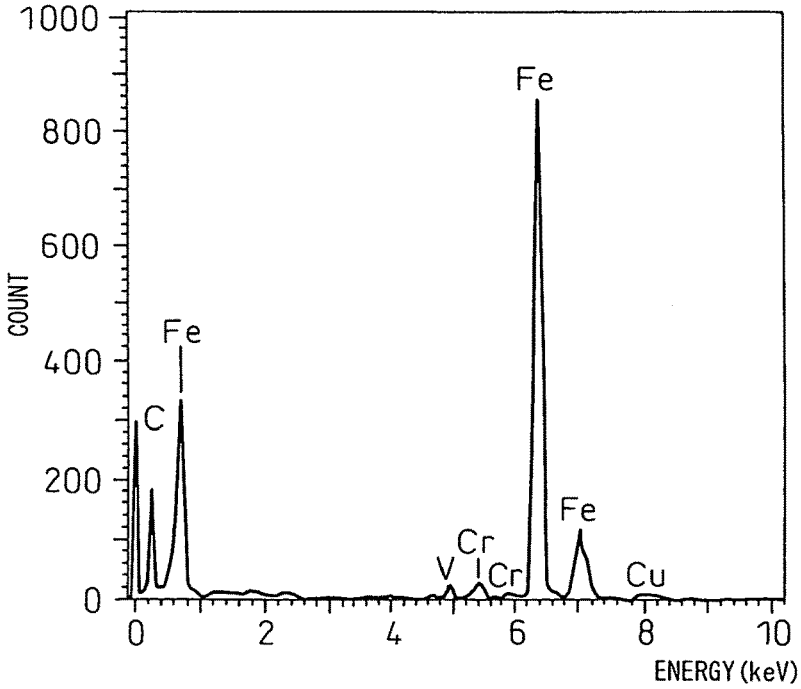

FIG. 2(*a*), (*b*) show examples of analysis by an EDX attached to an SEM. Results similar to analysis by the replica method by a transmission electron microscope are obtained. Conventional inventions focused only on the V, Nb, and other alloy element-based carbides. On example is shown in FIG. 2(*a*). This is characterized by an extremely small Fe peak in the carbides. However, in the present invention, it was discovered that the form of precipitation of not only the conventional alloy element-based carbides, but also, as shown in FIG. 2(*b*), the so-called cementite-based carbides having a circle equivalent diameter of 3 μm or less containing $Fe_3C$ and alloy elements slightly in solid solution is important. When trying to achieve both a high strength and workability equal to or greater than those of conventional steel wire like in the present invention, if the amount of the cementite-based spherical carbides of 3 μm or less is great, the workability is greatly impaired. Below, such spherical carbides mainly comprised of Fe and C as shown in FIG. 2(*b*) will be called "cementite-based carbides".

The carbides in the steel can be observed by etching a mirror polished sample by picral etc., but for detailed observation and evaluation of the dimensions etc., it is necessary to use a scan type electron microscope for observation by a high power of ×3000 or more. The cementite-based spherical carbides covered here have a circle equivalent diameter of 0.2 to 3 μm. Normally, carbides in steel are essential for securing the steel strength and tempering softening resistance, but if the effective grain size is 0.1 μm or less or conversely over 1 μm, this rather no longer contributes to the strength and greater fineness of the austenite grain size and only causes the deformation characteristics to deteriorate. However, in the prior art, the importance of this is not recognized much at all. V, Nb, and other alloy-based carbides are just noted. Carbides having a circle equivalent diameter of 3 μm or less, in particular cementite-based spherical carbides, are considered harmless. No examples can be found where the 0.1 to 5 μm or so carbides which the present invention mainly covers are studied.

Further, in the case of cementite-based spherical carbides having a circle equivalent diameter of 3 μm or less covered by the present invention, not only the dimensions, but also the number of the grains becomes a large factor. Therefore, both were considered in prescribing the range of the present invention. That is, even if the average grain size of the circle equivalent diameter is a small 0.2 to 3 μm, if the number is extremely large and the density of presence at the observed plane exceeds $1/\mu m^2$, the coiling characteristic remarkably deteriorates, so this is made the upper limit.

Further, if the dimensions of the carbide exceeds 3 μm, the effects of the dimensions become larger, so if the density of presence at the observed plane exceeds $0.001/\mu m^2$, the deterioration of the coiling characteristic becomes remarkable. Therefore, the density of presence at the observed plane of carbides of a circle equivalent diameter of over 3 μm of $0.001/\mu m^2$ was made the upper limit and the range of the present invention was made less than that.

Further, even if the cementite-based spherical carbides have dimensions as small as prescribed, if the area occupied at the observed plane by the cementite-based carbides having a circle equivalent diameter of 0.2 μm or more is over 7%, the coiling characteristic remarkably deteriorates and coiling is no longer possible. Therefore, in the present invention, the area occupied at the observed plane was defined as 7% or less.

Prior austenite grain size Number of #10 or More

In steel wire based on a tempered martensite structure, the prior austenite grain size has a large effect on the basic properties of the steel wire. That is, the smaller the prior austenite grain size, the better the fatigue characteristic and the coilability. However, no matter how small the austenite grain size, if the carbides are contained in more than the prescribed range, the effect is small. In general, to make the austenite grain size smaller, it is effective to make the heating temperature lower, but this conversely causes the carbides to increase. Therefore, it is important to produce the steel wire with a balance of the amount of carbides and the prior austenite grain size. Here, if the prior austenite grain size number is less than #10 when the carbides satisfy the above prescribed range, a sufficient fatigue characteristic and coilability cannot be obtained, so the prior austenite grain size was prescribed as being number #10 or more.

Further, for use for high strength springs, further finer grains are preferable. Making the size the #11 or #12 or more enables both high strength and coilability to be achieved.

Residual Austenite of 15 Mass % or Less

Residual austenite often remains at the segregated parts, prior austenite grain boundaries, and near regions sandwiched between subgrains. The residual austenite becomes martensite due to work induced transformation. If induced transformation occurs at the time of spring formation, locally high hard parts are formed and, rather, the coiling characteristic as a spring is reduced. Further, recent springs are strengthened at their surfaces by shot peening, setting, or other plastic deformation. When there is such a production process including a plurality of steps of applying plastic deformation in this way, the work induced martensite occurring at any early stage causes the breakage strain to fall and causes the workability and the breakage characteristic of the spring during use to fall. Further, the steel easily breaks during coiling even when casting flaws and other industrially unavoidable deformation are introduced.

Further, the steel gradually decomposes in nitridation, straightening annealing, and other heat treatment to cause the mechanical properties to change, cause the strength to fall, cause the coilability to drop, and cause other problems.

Therefore, the workability is improved by reducing the residual austenite as much as possible and suppressing the formation of work induced martensite.

Specifically, if the amount of the residual austenite exceeds 15% (mass %), the susceptibility to casting flaws etc. becomes greater and the steel easily breaks during coiling or other handling, so the amount is limited to 15% or less.

The amount of residual austeniste changes due to the amounts of addition of the C, Mn, and other alloy elements and the heat treatment conditions. For this reason, improvement of not only the design of the ingredients, but also the heat treatment conditions is important.

If the martensite producing temperature (start temperature Ms, end temperature Mf) becomes low, no martensite is produced unless the temperature becomes considerably low at the time of quenching and residual austenite easily remains. With industrial quenching, water or oil is used, but to suppress residual austenite, advanced heat treatment control becomes necessary. Specifically, it becomes necessary to keep the cooling medium low in temperature, maintain an extremely low temperature even after cooling, secure a long transformation time to martensite, or perform other control. Since the material is industrially processed on a continuous line, the temperature of the cooling medium easily rises to close to 100° C., but the material is preferably held at 60° C. or less, more preferably at a low temperature of 40° C. or less. Further, to sufficiently promote martensite transformation, it is necessary to hold the steel in the cooling medium for 1 second or more. It is also important to secure a holding time after cooling.

Area Rate of Cementite-Based Carbide Density Poor Region: 3% or Less

When subjecting the steel to various types of heat treatment to adjust the tensile strength to 2100 MPa or more, generally the structure becomes a ferrite base material with large dislocation and cementite dispersed in it called "tempered martensite". However, the distribution of the cementite is not at all uniform. The density often becomes uneven. The reason is that when quenching steel with an amount of C prescribed in the present invention, not only lath martensite, but also lenticular martensite is formed. The difference in the mechanism of precipitation of carbides in the tempering process is also a factor. Further, in actuality, there is also unevenness of added elements such as segregation and band structures. Sometimes like with residual austenite, a substance is austenite in the quenching process, but breaks down into ferrite and cementite in the tempering process. Therefore, there are various cementite producing sites, so uniform dispersion is difficult.

Figure 3:
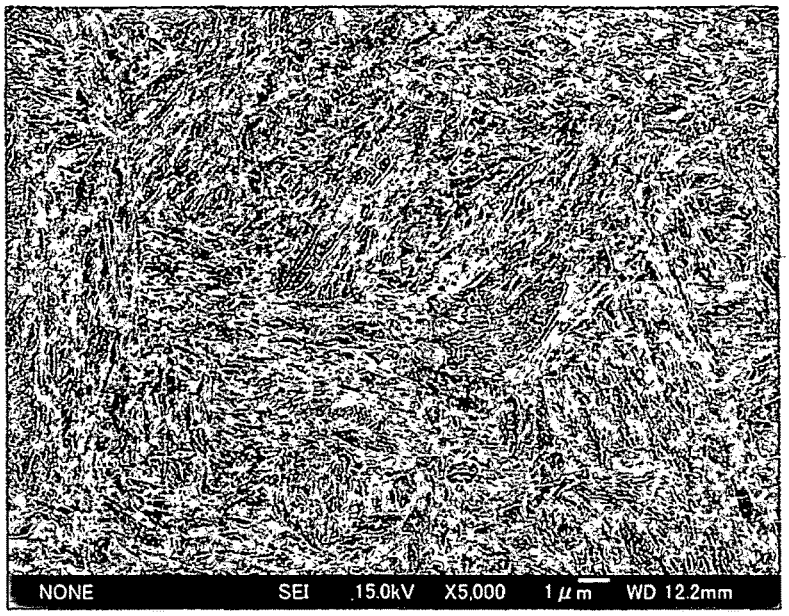
FIG. 3 are photographs of observed images in place of drawings showing the microstructures of etched surfaces of steel wire as seen by a scan type electron microscope, wherein (a) is a photograph in place of a drawing showing an example of observation of a typical microstructure and (b) is one showing an observed image of an example of a part with uneven carbide distribution.
Figure 3:
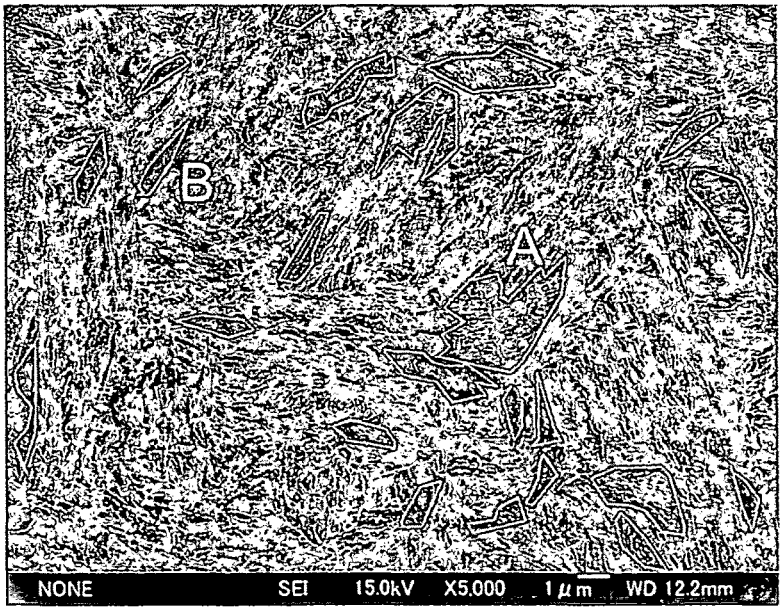

In the present invention, to achieve both high strength (linked with high hardness =fatigue durability property, nitridation characteristic, and settling) and ductility of the material (in the present invention, the mechanical properties directly linked with the coiling characteristic of the spring), it is important to make the microstructure even. FIG. 2 shows an example of photography by a set power of X5000. Specifically, as shown in FIG. 3(*b*), the regions of uneven microstructure such as shown by A and B are deemed "carbide poor regions". The inventors discovered that it is important to control the area ratio.

The carbide poor regions will be defined in more detail later, but when they are of a size of a circle equivalent diameter of less than 2 μm, there is no large effect dynamically, so they can be ignored.

Definition of Cementite-Based Carbide Density Poor Regions

Here, the definition of a carbide poor region will be explained in further detail.

If mirror polishing steel wire and electrolytically etching it, a slight amount of the ferrite will be dissolved away resulting in surface relief and exposing the crystal grain boundaries and produced carbides. This may be utilized to observe the microstructure of an etched surface of steel wire by a scan type electron microscope, in particular the carbide distribution.

Figure 4:
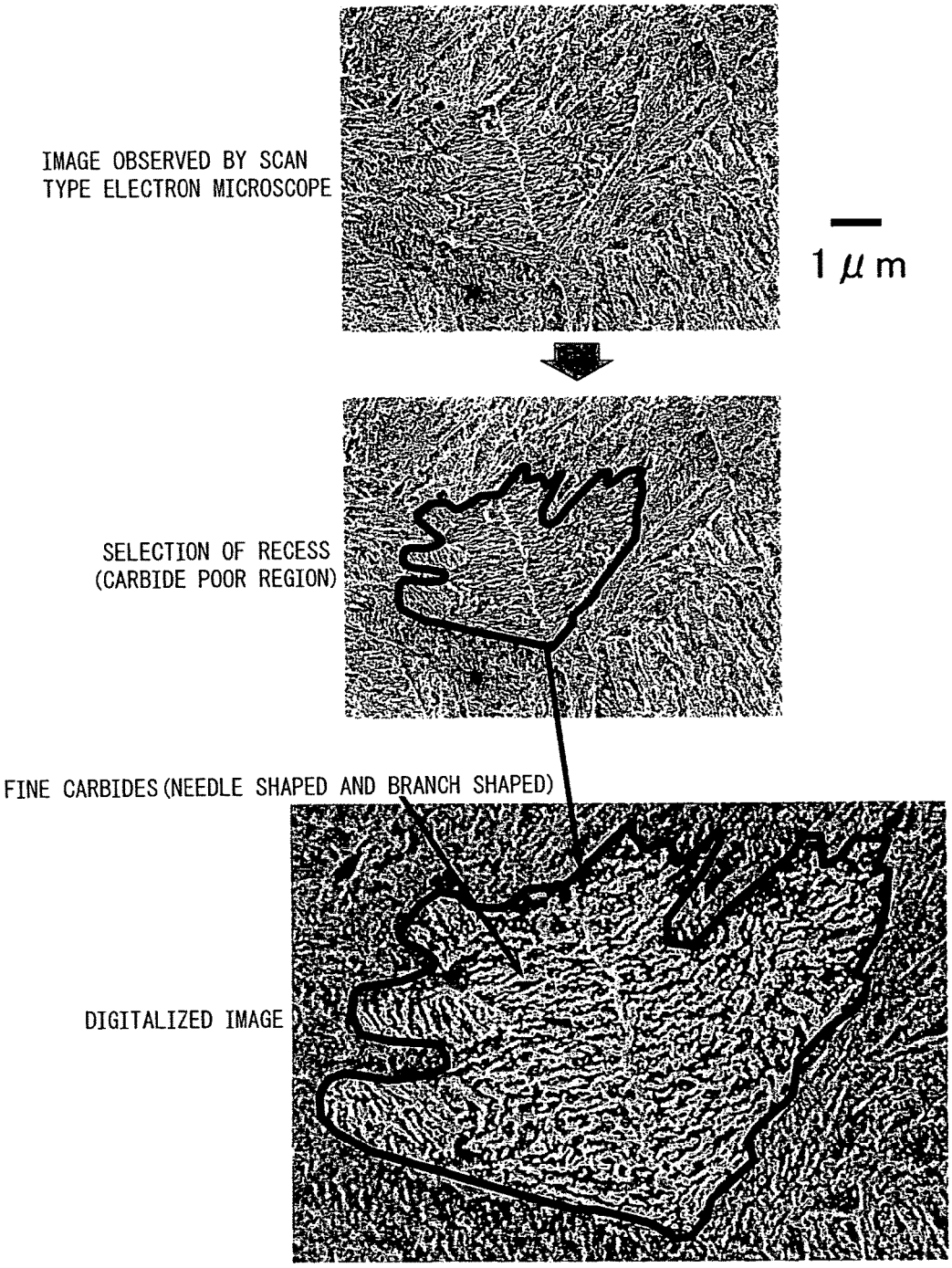
FIG. 4 are photographs in place of drawings showing a part of uneven carbide distribution in an observed image by a scan type electron microscope (carbide poor region) and the fine carbides (needle shaped and branch shape) by digital image processing.
Figure 5:
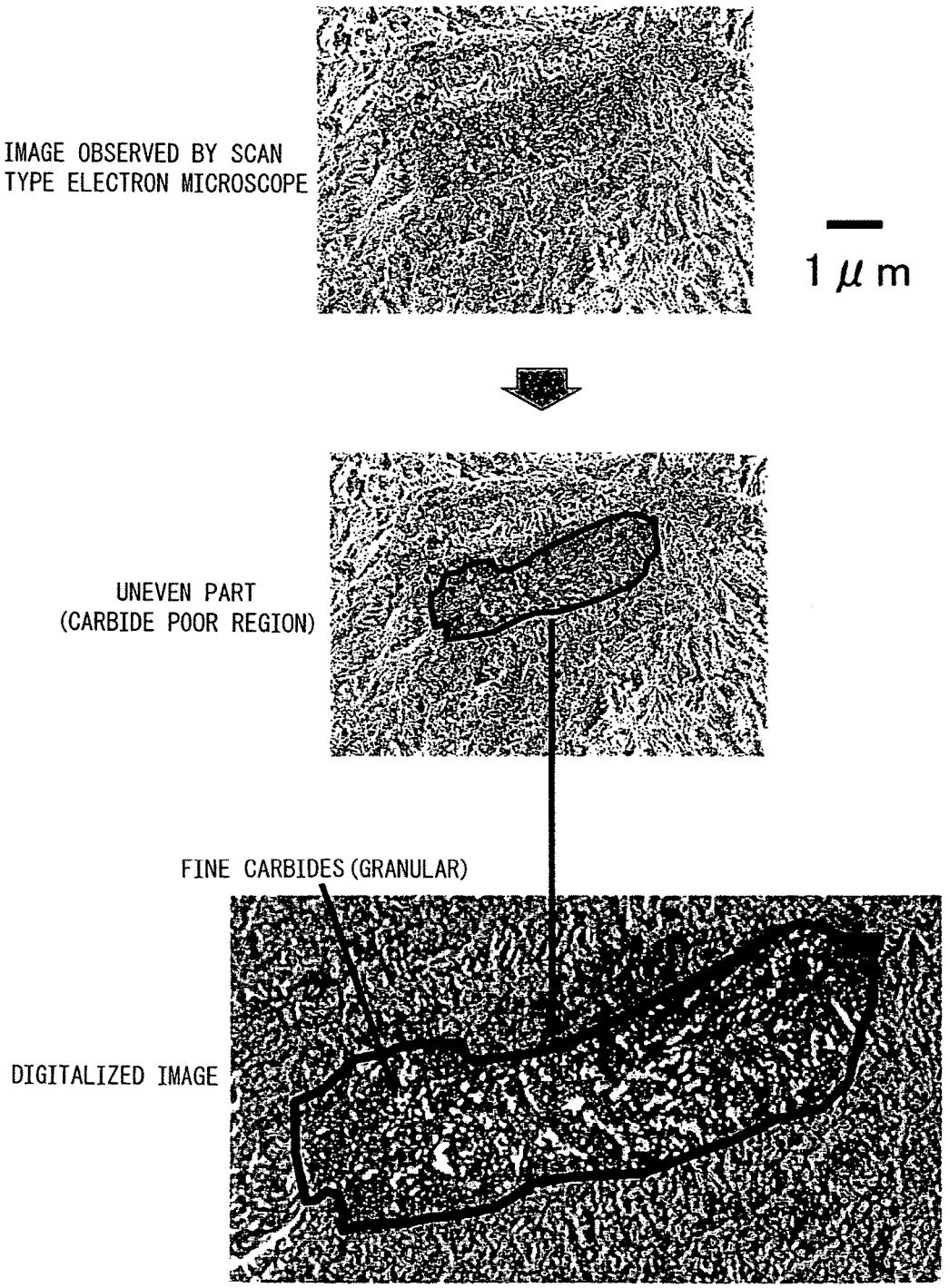
FIG. 5 are photographs in place of drawings showing a part of uneven carbide distribution in an observed image by a scan type electron microscope (carbide poor region) and the fine carbides (grain shape) by digital image processing.

Enlarged examples of uneven parts in the distribution of carbides such as shown in FIG. 3(*b*) are shown in FIG. 4 and FIG. 5. Inside, fine carbides are precipitated in a form of dispersion different from the surrounding structures or are present in an extremely small ratio. Even when carbides cannot be clearly seen, they are more deeply corroded compared with the surroundings and form recesses.

In the observation of the microstructure after etching, the carbides appear white in the observed image. In the present invention, when the occupied area ratio of the carbides in a corroded and recessed region is 60% or less, the region is defined as a carbide poor region. When carbides precipitate in this carbide poor region, two cases are seen: the case where needle shaped and further branch shaped carbides are seen in the recessed region (FIG. 4) and the case where granular carbides are seen (FIG. 5). The fine carbides have a size of (1) in the case of needle shaped or branch shaped carbides, an individual thickness of 0.3 μm or less and (2) in the case of granular carbides, a circle equivalent diameter of 0.7 μm or less. Regions with the presence of carbides larger than this are excluded from the carbide poor regions.

The thus selected carbide distribution poor regions, that is, regions having a circle equivalent diameter of 2 μm or more, have an effect on the dynamic characteristics, so cannot be ignored. Therefore, such carbide poor regions having a circle equivalent diameter of 2 μm or more are limited.

Method of Measurement of Cementite-Based Carbide Density Poor Region

Heat treated steel wire is polished and electrolytically etched to form (1) locations where fine carbides precipitate and the density of the number of carbides is smaller than the surroundings and (2) locations where recesses are formed by corrosion by etching.

The electrolytic etching was performed in an electrolyte (a mixed solution of 10 mass % of acetyl acetone, 1 mass % of tetramethyl ammonium chloride, and the balance of methyl alcohol) using a sample as an anode and platinum as a cathode and using a low potential current generator so as to corrode the sample surface by electrolytic action.

The potential was made a constant potential suited to the sample in the range of −50 to −200 mV vs SCE. For the steel wire of the present invention, usually a constant −100 mV vs SCE is suitable.

The amount of current conducted depends on the total surface area of the sample material. The "total surface area of the material"×0.133 [c/cm$^2$] is made the amount of current conducted. Even when embedded, the area of the surface of the sample embedded in the resin is added to calculate the sample total surface area. By running the current for 10 seconds, then stopping and washing the result, it is possible to easily use a scan type electron microscope to observe the microstructure of the cementite and other carbides in the steel.

By observing this corroded surface by a scan type electron microscope at ×1000 or more power, the carbide poor regions can be identified. In observation of the microstructure after etching using a scan type electron microscope, the carbides appear white in the observed image, so the candidate regions for the carbide poor regions are photographed by a scan type electron microscope. The power is X1000 or more, preferably X5000 to X10000.

First, if a candidate region for a carbide poor region has a size of less than 2 μm in terms of circle equivalent diameter, the region has little effect on the dynamic characteristics, so is ignored. On the other hand, if a candidate region for a carbide poor region is 2 μm or more in circle equivalent diameter, the internal carbide distribution is measured. A candidate region of a carbide poor region included in the photographed candidate regions of carbide poor regions was digitalized by an image processing system Luzex to measure the area and circle equivalent diameter of the candidate region and occupied area ratio and circle equivalent diameter of the carbides in the candidate region. When the occupied area ratio of the carbides is 60% or less of the candidate region, the candidate region was deemed to be a carbide poor region.

The areas and circle equivalent diameters of the thus extracted carbide poor regions were calculated by an image processing system and the occupied area ratio of the carbide poor regions having a circle equivalent diameter of 2 μm or more seen in the measured field was measured. In the present invention, this was limited to 3% or less.

For the observed location, parts near the center of the radius of the heat treated wire material (steel wire), so-called ½R parts, were randomly observed so as to eliminate special conditions such as decarburization or center segregation. The measurement area was 3000 μm$^2$ or more.

If the area ratio of the carbide poor regions is 3% or less, the coilability is good. Even with a high strength over 2200 MPa, good coiling is possible without impairing the coilability. Therefore, it was made the upper limit. The coilability is better the smaller the ratio of the carbide poor regions. Therefore, the ratio is preferably 1% or less.

Note that even when making the size of the carbide poor regions strictly ignored less than 1 μm in circle equivalent diameter, the bending workability falls when the poor region area ratio exceeds 5%.

Method of Suppression of Area Ratio of Cementite-Based Poor Regions

In general, spring steel is continuously cast, then the billet is rolled and the wire material is rolled and drawn. In a cold coiling spring, strength is imparted by oil tempering or high frequency treatment. At this time, to suppress the cementite-based carbide poor regions, it is important to avoid local unevenness of the material and make the heat treated structure uniform and important to make the structure a uniform, suitable tempered martensite structure. At this time, the inventors discovered that a tempered structure of lath martensite is preferable.

As causes of local unevenness in a tempered lath martensite structure, (1) undissolved carbides, (2) segregation, (3) residual austenite, (4) coarse prior austenite grains, (5) lenticular martensite, (6) local bainite, etc. may be considered. These (1) to (6) have a large effect on the distribution of carbides after heat treatment of the spring-use steel wire. Suppressing these is effective for reducing the area ratio of the cementite-based carbide poor regions. Note that uneven hard inclusions may also be considered, but with quenching and tempering and with other heat treatment, there is almost no change, so there is no need to consider them.

For example, to suppress alloy-based undissolved carbides and cementite-based spherical carbides, note must be paid to oil tempering, high frequency treatment, and other final heat treatment determining the strength of steel wire and the rolling before the drawing as well. That is, cementite-based spherical carbides and alloy-based carbides are considered to grow using undissolved cementite or alloy carbides in the rolling etc. as nuclei, so it is important to dissolve sufficient ingredients in the rolling or other various heating processes. In the present invention, the inventors discovered that rolling by heating to a high temperature enabling sufficient dissolution even in rolling and then drawing is important.

If the carbides do not sufficiently dissolve at the rolling stage or patenting stage and are sent on to the final heat treatment, the C in the process of diffusion will segregate around the undissolved carbides. Further, for example even if the carbides dissolve, concentrated regions of C or R often remain as results of the undissolved carbides. At the time of quenching, local lenticular martensite easily forms around the undissolved carbides or the concentrated regions.

Lenticular martensite inherently tends to be easily produced when the amount of the C and other alloy elements is large, so when there are few undissolved carbides and large segregation or when the added elements other than Fe including C of the basic ingredient are large, lenticular martensite is easily formed and becomes a cause for uneven structure.

Further, if the austenite grain size is large at the time of heat treatment, the lenticular martensite also becomes too large, so this is disadvantageous for suppressing the cementite-based carbide poor regions.

If there is a large amount of residual austenite, there are many regions with a lean distribution of cementite-based carbides.

Further, if the quenching ability is insufficient and a martensite structure is not formed, even if bainite is formed, unevenness different from the tempered structure of lath martensite suitable for spring steel will be formed. This is disadvantageous for suppression of cementite-based carbide poor regions.

Based on this discovery, the rolling is performed by heating once at a temperature over 1100° C. before heat treatment and drawing and is completed within 5 minutes after extraction so that the precipitates do not grow large. The heating temperature is preferably 1150° C. or more, more preferably 1200° C. or more.

Further, at the time of patenting before drawing and in the subsequent quenching and tempering process as well, the material is heated at a temperature of 900° C. or more for heat treatment. The heating temperature at the time of patenting is preferably a high temperature. 930° C. or more, more preferably 950° C. or more is preferable.

At the time of quenching and tempering, the material is treated by heating it by a heating rate of 10° C./s or more, holding it at a holding time of 5 minutes or less at the $A_3$ point or a higher temperature, cooling it by a cooling rate of 50° C./s to 100° C., heating it by a heating rate of 10° C./s or more, and holding it for a holding time of 15 minutes or less at the tempering temperature. From the viewpoint of dissolution of the carbides, heating sufficiently higher than the $A_3$ point is preferable. On the other hand, completion in a short time is preferable so as to prevent growth of the austenite grains.

The refrigerant at the time of quenching is 70° C. or less, more preferably a low 60° C. or less. This is to avoid the formation of residual austenite and bainite. Further, the cooling time is preferably made as long as possible to suppress the residual austenite and enable sufficient completion of martensite transformation.

Even when patenting is omitted, it is important to heat the material at a high temperature in advance so as to enable the carbides to sufficiently dissolve from the rolling stage to heating during quenching.

In this way, to reduce the carbide poor region area ratio, it is effective to use suitable chemical ingredients and heat treatment suitable for the same to suppress the segregation of the lenticular martensite and residual austenite and reduce the size of the prior austenite grains. To reduce the size of the prior austenite grains, it is effective to reduce the heating temperature and shorten the heating time. Since there is a danger of increasing the undissolved carbides, it is necessary to suppress the undissolved carbides and suppress the carbide poor region. To achieve higher strength, the chemical ingredients and the rolling are controlled to meet with the same. In the patenting and other intermediate heating steps as well, it is necessary to dissolve sufficient alloy elements.

EXAMPLES

Example 1

Tables 1 to 3 show the ingredients of the steel materials prepared for evaluating the various types of performance, while Tables 4 to 6 show the methods of melting, properties, etc. of the steel materials. The steel materials were melted in small vacuum melting furnaces (either of 10 kg, 150 kg, or 2 ton) and further a 270 ton converter. The furnaces used for melting in the examples are shown. In the case of melting in a vacuum melting furnace, a magnesia crucible is used and otherwise sufficient care is taken regarding the entry of oxide producing elements from refractories and materials. The ingredients are adjusted to give the same composition as an actual converter melted material.

Among these small amounts of melted samples, the 150 kg material was welded to a dummy billet and rolled. Further, the 10 kg melted material was forged to ϕ13, then heat treated (normalized), and machined (ϕ10 mm×400 mm) in that order to prepare a thin straight rod. At this stage, the distribution of surface oxides, the carbides in the steel, etc. were observed.

On the other hand, an invention example (Example 33) and a comparative example (Example 62) of the present invention were refined by a 270 t converter and continuously cast to prepare billets. Further, the other examples were melted by a 2 ton vacuum melting furnace, then rolled to prepare billets. At this time, the invention examples were held at a 1200° C. or more high temperature for a certain time. After this, in each case, the billets were rolled to ϕ8 mm.

In the fabrication of springs, these materials are further patented and drawn and further quenched and tempered using an industrial continuous furnace.

Therefore, in the test materials, the 10 kg melted material was worked to straight rods, so these were connected to dummy wire rods, then industrially patented, drawn, quenched using a heating furnace, and tempered using a lead tank to obtain steel wire.

150 kg melted material, 2 ton vacuum melted material, and 270 ton converter melted material were rolled by actual machine, so were patented as they were, drawn, then quenched and tempered using a heating furnace to obtain steel wire. The heating temperature in the patenting was 900° C. or more. 930° C. or more is preferable. In the present invention, the temperature was made 950° C.

These materials were drawn to ϕ4 mm. On the other hand, the comparative examples were rolled under ordinary rolling conditions and used for drawing.

Further, the present invention and comparative steels drawn to ϕ4 mm were evaluated for chemical ingredients, tensile strength, coiling characteristics (elongation at the time of tensile test), hardness after annealing, and average fatigue strength.

The strength differs depending on the chemical ingredients, but in the present invention, heat treatment was performed to give a tensile strength of 2200 MPa or more. On the other hand, in the comparative examples as well, heat treatment was performed under the same tempering temperature.

That is, with quenching and tempering, the time for passage through the heating furnace was set so that the inside of the steel of the drawn material was sufficiently heated. In this example, the heating temperature was set to 950° C., the heating time to 300 second, the quenching temperature to 50° C. (actually measured temperature of oil tank), and the cooling time to a long 5 minutes or more. Further, the tempering was performed in a lead tank at a temperature of 450° C. for a tempering time of 3 minutes to adjust the strength. As a result, the obtained tensile strength in an air atmosphere was as shown in Table 1.

The obtained steel wire was used as is for obtaining the tensile characteristic. Parts were annealed at 400° C. for 30 minutes, measured for hardness, then used for a rotational bending fatigue test. The fatigue test pieces were shot peened to remove the heat treatment scale from the surface.

The tensile characteristics were obtained from a JIS Z 2201 No. 9 test piece based on JIS Z 2241. The tensile strength was calculated from the breakage load.

The fatigue test is a Nakamura rotational bending fatigue test. The maximum load stress where 10 samples exhibit a life of $10^7$ cycles or more by a 50% or higher probability was defined as the average fatigue strength.

Further, the breakage starting points of the broken surfaces of the broken samples were confirmed by a scan type electron microscope. The probability of occurrence of breakage considered to be due to inclusions was evaluated as the rate of appearance of inclusions.

Table 1 to Table 3 show the chemical ingredients, while the results of evaluation are shown in Table 4 to Table 6. For ϕ4 mm steel wire, if the chemical ingredients are outside of the prescribed range, the elongation, which is an indicator of the coilability, becomes small, the coiling characteristic deteriorates, the Nakamura type rotational bending fatigue strength deteriorates, and the material cannot be used for a high strength spring.

Examples 61 to 63 have insufficient amounts of W below the prescribed range, so are insufficient in softening resistance and cannot secure sufficient fatigue durability. The internal hardness after holding at 450° C. for 1 hour for heat treatment for simulating nitridation is on a par with a conventional spring at HV550 or less. It is learned that further softening resistance is required.

Examples 64 and 65 are examples where the Zr is in the prescribed range, but Al is added beyond the prescribed range. This has an effect on the mode of presence of the oxide-based inclusions and the fatigue durability tends to decline.

Further, this also has an effect on the ability of Zr to control the sulfides. Even if Zr is added in an amount in the prescribed range, if Al is large, it will produce oxides not suited to precipitation of sulfides, so this will also affect the coilability and cause it to decline.

Examples 66 to 68 are cases where the amount of addition of Zr is greater than the prescribed range. When Zr is large, it has an effect on the dimensions of the oxide-based inclusions and the fatigue durability falls. In this case as well, oxides are produced not suitable for sulfide precipitation, therefore the coilability is also affected and falls.

Examples 69 to 71 are cases having amounts of addition of Zr smaller than the prescribed range. If the amount of Zr is small, control of the sulfides is not sufficient, so the coilability (elongation) is reduced and the workability in the high strength steel wire cannot be secured.

Example 72 is a case where Mg is added in a larger amount than the prescribed range, while Example 73 is a case where Ti is added in a larger amount than the prescribed range. In the former case, oxide-based hard inclusions are observed, while in the latter case, nitride-based hard inclusions are observed and the fatigue durability falls.

Examples 65, 74, and 75 are examples where the amount of addition of oxide producing element exceeds the prescribed range and the fatigue strength falls.

Further, Examples 76 and 77 are cases where the amount of C is less than the prescribed range. Sufficient strength could not be secured in the industrial quenching tempering step and the fatigue strength as a high strength spring was insufficient.

Further, Examples 78 and 79 further had amounts of C in excess over the prescribed range. In this case, the strength was secured, but the coiling characteristic was inferior and the workability in the high strength steel wire could not be secured.

TABLE 1

| | | Chemical ingredients | | | | | | | | | | |
|---|---|---|---|---|---|---|---|---|---|---|---|---|
| Ex. | No | C | Si | Mn | P | S | Cr | W | Ti | Al | Zr | Mg |
| Inv. ex. | 1 | 0.67 | 2.13 | 0.43 | 0.001 | 0.001 | 1.46 | 0.21 | 0.002 | 0.001 | 0.0001 | 0.0004 |
| Inv. ex. | 2 | 0.69 | 2.21 | 0.83 | 0.006 | 0.002 | 1.30 | 0.15 | 0.003 | 0.002 | 0.0003 | 0.0002 |
| Inv. ex. | 3 | 0.70 | 2.26 | 0.65 | 0.006 | 0.005 | 1.50 | 0.16 | 0.001 | 0.003 | 0.0001 | 0.0002 |
| Inv. ex. | 4 | 0.65 | 2.09 | 0.72 | 0.009 | 0.004 | 1.33 | 0.19 | 0.001 | 0.003 | 0.0001 | 0.0005 |
| Inv. ex. | 5 | 0.69 | 1.88 | 0.51 | 0.006 | 0.006 | 1.22 | 0.15 | 0.002 | 0.001 | 0.0002 | 0.0004 |
| Inv. ex. | 6 | 0.66 | 1.83 | 0.53 | 0.008 | 0.007 | 1.31 | 0.21 | 0.002 | 0.003 | 0.0003 | 0.0003 |
| Inv. ex. | 7 | 0.68 | 2.27 | 0.21 | 0.006 | 0.002 | 1.19 | 0.19 | 0.003 | 0.003 | 0.0003 | 0.0003 |
| Inv. ex. | 8 | 0.67 | 2.17 | 0.47 | 0.001 | 0.002 | 1.16 | 0.17 | 0.002 | 0.001 | 0.0002 | 0.0002 |
| Inv. ex. | 9 | 0.68 | 2.14 | 0.82 | 0.008 | 0.006 | 1.44 | 0.19 | 0.002 | 0.001 | 0.0002 | 0.0002 |
| Inv. ex. | 10 | 0.61 | 2.29 | 0.59 | 0.009 | 0.005 | 1.32 | 0.22 | 0.003 | 0.002 | 0.0006 | 0.0003 |
| Inv. ex. | 11 | 0.68 | 1.97 | 0.43 | 0.005 | 0.003 | 1.48 | 0.16 | <0.001 | 0.000 | 0.0001 | — |
| Inv. ex. | 12 | 0.62 | 2.26 | 0.59 | 0.004 | 0.005 | 1.36 | 0.16 | <0.001 | 0.001 | 0.0003 | — |
| Inv. ex. | 13 | 0.65 | 1.81 | 0.57 | 0.004 | 0.007 | 1.18 | 0.16 | <0.001 | 0.000 | 0.0002 | — |
| Inv. ex. | 14 | 0.67 | 2.26 | 0.89 | 0.007 | 0.001 | 1.21 | 0.15 | <0.001 | 0.000 | 0.0002 | — |
| Inv. ex. | 15 | 0.62 | 1.98 | 0.59 | 0.004 | 0.008 | 1.24 | 0.21 | <0.001 | 0.002 | 0.0003 | — |
| Inv. ex. | 16 | 0.67 | 1.96 | 0.52 | 0.006 | 0.002 | 1.10 | 0.20 | <0.001 | 0.003 | 0.0003 | — |
| Inv. ex. | 17 | 0.66 | 2.02 | 0.76 | 0.005 | 0.002 | 1.38 | 0.19 | <0.001 | 0.001 | 0.0002 | — |
| Inv. ex. | 18 | 0.67 | 2.19 | 0.23 | 0.008 | 0.006 | 1.32 | 0.16 | 0.002 | 0.002 | 0.0003 | — |
| Inv. ex. | 19 | 0.63 | 2.18 | 0.29 | 0.009 | 0.006 | 1.16 | 0.17 | <0.001 | 0.002 | 0.0002 | — |
| Inv. ex. | 20 | 0.61 | 1.82 | 0.45 | 0.002 | 0.007 | 1.35 | 0.19 | <0.001 | 0.003 | 0.0002 | 0.0004 |
| Inv. ex. | 21 | 0.62 | 2.10 | 0.82 | 0.003 | 0.009 | 1.42 | 0.19 | 0.003 | 0.002 | 0.0001 | 0.0004 |
| Inv. ex. | 22 | 0.58 | 2.21 | 0.78 | 0.007 | 0.003 | 1.11 | 0.19 | 0.003 | 0.002 | 0.0003 | 0.0002 |
| Inv. ex. | 23 | 0.56 | 2.15 | 0.66 | 0.002 | 0.003 | 1.11 | 0.15 | 0.002 | 0.003 | 0.0003 | 0.0004 |
| Inv. ex. | 23 | 0.60 | 1.84 | 0.87 | 0.003 | 0.002 | 1.48 | 0.15 | 0.002 | 0.003 | 0.0003 | 0.0001 |
| Inv. ex. | 23 | 0.62 | 1.94 | 0.12 | 0.003 | 0.008 | 1.31 | 0.19 | <0.001 | 0.000 | 0.0002 | — |
| Inv. ex. | 24 | 0.55 | 1.98 | 0.27 | 0.007 | 0.008 | 1.32 | 0.19 | 0.003 | 0.001 | 0.0002 | 0.0004 |
| Inv. ex. | 25 | 0.52 | 2.17 | 0.23 | 0.005 | 0.008 | 1.41 | 0.15 | 0.001 | 0.003 | 0.0002 | 0.0005 |
| Inv. ex. | 26 | 0.67 | 0.28 | 0.63 | 0.005 | 0.007 | 1.46 | 0.14 | 0.003 | 0.001 | 0.0003 | 0.0001 |
| Inv. ex. | 27 | 0.69 | 2.52 | 0.54 | 0.003 | 0.006 | 1.13 | 0.14 | 0.001 | 0.001 | 0.0002 | 0.0003 |
| Inv. ex. | 28 | 0.69 | 2.12 | 0.67 | 0.005 | 0.007 | 1.72 | 0.21 | 0.001 | 0.002 | 0.0001 | 0.0005 |
| Inv. ex. | 29 | 0.65 | 1.91 | 0.51 | 0.009 | 0.003 | 1.30 | 0.41 | 0.001 | 0.002 | 0.0001 | 0.0003 |
| Inv. ex. | 30 | 0.67 | 2.14 | 1.32 | 0.008 | 0.008 | 1.28 | 0.19 | 0.001 | 0.002 | 0.0001 | 0.0001 |

TABLE 1-continued

| Ex. | Chemical ingredients | | | | | | | | | | | | |
|---|---|---|---|---|---|---|---|---|---|---|---|---|---|
| | N | t-O | Mo | V | Nb | Ni | Cu | Co | B | Ca | Hf | Te | Sb |
| Inv. ex. | 0.0039 | 0.0018 | — | — | — | — | — | — | — | — | — | — | — |
| Inv. ex. | 0.0021 | 0.0014 | — | 0.14 | — | — | — | — | — | — | — | — | — |
| Inv. ex. | 0.0056 | 0.0020 | — | 0.24 | — | — | — | — | — | — | — | — | — |
| Inv. ex. | 0.0031 | 0.0014 | 0.19 | — | — | — | — | — | — | — | — | — | — |
| Inv. ex. | 0.0020 | 0.0019 | 0.21 | — | — | — | — | — | — | — | — | — | — |
| Inv. ex. | 0.0047 | 0.0018 | 0.14 | — | — | — | — | — | — | — | — | — | — |
| Inv. ex. | 0.0036 | 0.0018 | 0.22 | — | — | — | — | — | — | — | — | — | — |
| Inv. ex. | 0.0022 | 0.0014 | — | — | — | — | — | — | — | — | — | — | — |
| Inv. ex. | 0.0039 | 0.0009 | — | — | — | — | — | — | — | — | — | — | — |
| Inv. ex. | 0.0044 | 0.0015 | — | 0.09 | — | — | — | — | — | — | — | — | — |
| Inv. ex. | 0.0030 | 0.0016 | — | 0.15 | — | — | — | — | — | — | — | — | — |
| Inv. ex. | 0.0053 | 0.0010 | 0.24 | 0.22 | — | — | — | — | — | — | — | — | — |
| Inv. ex. | 0.0045 | 0.0009 | 0.18 | 0.13 | — | — | — | — | — | — | — | — | — |
| Inv. ex. | 0.0032 | 0.0013 | 0.14 | 0.09 | — | — | — | — | — | — | — | — | — |
| Inv. ex. | 0.0021 | 0.0019 | 0.10 | 0.12 | — | — | — | — | — | — | — | — | — |
| Inv. ex. | 0.0040 | 0.0018 | 0.21 | 0.25 | — | — | — | — | — | — | — | — | — |
| Inv. ex. | 0.0023 | 0.0011 | 0.18 | 0.12 | — | — | — | — | — | — | — | — | — |
| Inv. ex. | 0.0035 | 0.0012 | 0.15 | 0.22 | — | — | — | — | — | — | — | — | — |
| Inv. ex. | 0.0056 | 0.0017 | 0.18 | 0.15 | — | — | — | — | — | — | — | — | — |
| Inv. ex. | 0.0031 | 0.0009 | 0.18 | 0.23 | — | — | — | — | — | — | — | — | — |
| Inv. ex. | 0.0045 | 0.0018 | 0.22 | 0.14 | — | — | — | — | — | — | — | — | — |
| Inv. ex. | 0.0032 | 0.0009 | 0.12 | 0.18 | — | — | — | — | — | — | — | — | — |
| Inv. ex. | 0.0021 | 0.0008 | 0.09 | 0.24 | — | — | — | — | — | — | — | — | — |
| Inv. ex. | 0.0051 | 0.0010 | 0.10 | 0.18 | — | — | — | — | — | — | — | — | — |
| Inv. ex. | 0.0031 | 0.0019 | 0.18 | 0.10 | — | — | — | — | — | — | — | — | — |
| Inv. ex. | 0.0034 | 0.0008 | 0.18 | 0.11 | — | — | — | — | — | — | — | — | — |
| Inv. ex. | 0.0023 | 0.0010 | 0.15 | 0.23 | — | — | — | — | — | — | — | — | — |
| Inv. ex. | 0.0056 | 0.0009 | 0.13 | 0.09 | — | — | — | — | — | — | — | — | — |
| Inv. ex. | 0.0054 | 0.0013 | 0.11 | 0.09 | — | — | — | — | — | — | — | — | — |
| Inv. ex. | 0.0031 | 0.0014 | 0.25 | 0.23 | — | — | — | — | — | — | — | — | — |
| Inv. ex. | 0.0041 | 0.0014 | 0.19 | 0.17 | — | — | — | — | — | — | — | — | — |
| Inv. ex. | 0.0051 | 0.0012 | 0.17 | 0.14 | — | — | — | — | — | — | — | — | — |

TABLE 2

| Ex. | No | Chemical ingredient | | | | | | | | | | | | |
|---|---|---|---|---|---|---|---|---|---|---|---|---|---|---|
| | | C | Si | Mn | P | S | Cr | W | Ti | Al | Zr | Mg | N | t-O |
| Inv. ex. | 31 | 0.65 | 2.64 | 0.15 | 0.003 | 0.005 | 1.03 | 0.18 | 0.002 | 0.001 | 0.0002 | 0.0004 | 0.0021 | 0.0011 |
| Inv. ex. | 32 | 0.67 | 1.44 | 0.27 | 0.009 | 0.009 | 0.18 | 0.19 | 0.003 | 0.003 | 0.0003 | 0.0003 | 0.0039 | 0.0018 |
| Inv. ex. | 33 | 0.65 | 1.79 | 0.35 | 0.008 | 0.007 | 0.83 | 0.18 | <0.001 | 0.001 | 0.0001 | — | 0.0054 | 0.0019 |
| Inv. ex. | 34 | 0.67 | 2.63 | 0.34 | 0.007 | 0.003 | 0.22 | 0.18 | <0.001 | 0.002 | 0.0003 | — | 0.0059 | 0.0015 |
| Inv. ex. | 35 | 0.68 | 1.83 | 0.27 | 0.005 | 0.004 | 1.26 | 0.20 | <0.001 | 0.002 | 0.0003 | — | 0.0053 | 0.0008 |
| Inv. ex. | 36 | 0.66 | 1.10 | 0.92 | 0.010 | 0.001 | 0.25 | 0.21 | 0.001 | 0.001 | 0.0002 | 0.0003 | 0.0075 | 0.0011 |
| Inv. ex. | 37 | 0.68 | 1.34 | 0.64 | 0.004 | 0.008 | 1.16 | 0.15 | 0.002 | 0.001 | 0.0001 | 0.0001 | 0.0080 | 0.0015 |
| Inv. ex. | 38 | 0.67 | 1.68 | 0.81 | 0.009 | 0.008 | 1.14 | 0.22 | 0.001 | 0.002 | 0.0002 | 0.0002 | 0.0083 | 0.0011 |
| Inv. ex. | 39 | 0.69 | 1.88 | 0.85 | 0.005 | 0.004 | 1.40 | 0.17 | 0.002 | 0.003 | 0.0003 | 0.0001 | 0.0071 | 0.0011 |
| Inv. ex. | 40 | 0.70 | 1.93 | 0.83 | 0.003 | 0.003 | 0.11 | 0.16 | 0.003 | 0.001 | 0.0001 | 0.0003 | 0.0079 | 0.0012 |
| Inv. ex. | 41 | 0.69 | 2.03 | 0.61 | 0.003 | 0.005 | 0.05 | 0.17 | 0.001 | 0.002 | 0.0003 | 0.0003 | 0.0059 | 0.0013 |
| Inv. ex. | 42 | 0.65 | 2.13 | 1.05 | 0.010 | 0.009 | 0.71 | 0.13 | 0.003 | 0.001 | 0.0002 | 0.0001 | 0.0028 | 0.0012 |
| Inv. ex. | 43 | 0.66 | 2.24 | 1.07 | 0.005 | 0.001 | 0.45 | 0.12 | 0.001 | 0.001 | 0.0003 | 0.0003 | 0.0028 | 0.0018 |
| Inv. ex. | 44 | 0.69 | 2.38 | 1.15 | 0.007 | 0.008 | 1.27 | 0.14 | 0.002 | 0.001 | 0.0002 | 0.0004 | 0.0058 | 0.0015 |
| Inv. ex. | 45 | 0.68 | 2.38 | 0.96 | 0.011 | 0.002 | 0.01 | 0.09 | 0.001 | 0.002 | 0.0002 | 0.0001 | 0.0039 | 0.0009 |
| Inv. ex. | 46 | 0.67 | 2.17 | 0.95 | 0.009 | 0.007 | 0.09 | 0.22 | 0.002 | 0.001 | 0.0002 | 0.0002 | 0.0026 | 0.0013 |
| Inv. ex. | 47 | 0.63 | 2.38 | 0.92 | 0.003 | 0.002 | 0.46 | 0.34 | 0.002 | 0.001 | 0.0002 | 0.0001 | 0.0040 | 0.0011 |
| Inv. ex. | 48 | 0.66 | 2.49 | 0.45 | 0.012 | 0.006 | 0.97 | 0.21 | 0.001 | 0.001 | 0.0002 | 0.0001 | 0.0034 | 0.0015 |
| Inv. ex. | 49 | 0.65 | 2.51 | 1.13 | 0.006 | 0.006 | 0.42 | 0.18 | 0.001 | 0.001 | 0.0001 | 0.0002 | 0.0025 | 0.0015 |
| Inv. ex. | 50 | 0.66 | 2.38 | 0.99 | 0.003 | 0.002 | 0.10 | 0.16 | 0.002 | 0.001 | 0.0002 | 0.0004 | 0.0036 | 0.0010 |
| Inv. ex. | 51 | 0.66 | 1.79 | 0.55 | 0.005 | 0.007 | 0.97 | 0.19 | <0.001 | 0.002 | 0.0001 | — | 0.0036 | 0.0013 |
| Inv. ex. | 52 | 0.68 | 2.61 | 0.20 | 0.007 | 0.006 | 0.57 | 0.20 | 0.002 | 0.001 | 0.0002 | 0.0002 | 0.0059 | 0.0012 |
| Inv. ex. | 53 | 0.67 | 1.89 | 0.21 | 0.007 | 0.005 | 0.30 | 0.21 | 0.002 | 0.001 | 0.0002 | 0.0002 | 0.0044 | 0.0009 |
| Inv. ex. | 54 | 0.65 | 1.40 | 0.82 | 0.010 | 0.001 | 0.42 | 0.20 | 0.002 | 0.002 | 0.0001 | 0.0003 | 0.0046 | 0.0008 |
| Inv. ex. | 55 | 0.70 | 1.45 | 0.99 | 0.002 | 0.005 | 1.29 | 0.21 | 0.001 | 0.001 | 0.0001 | 0.0001 | 0.0024 | 0.0014 |
| Inv. ex. | 56 | 0.65 | 1.64 | 0.40 | 0.011 | 0.002 | 0.11 | 0.21 | 0.001 | 0.002 | 0.0003 | 0.0004 | 0.0058 | 0.0018 |
| Inv. ex. | 57 | 0.69 | 2.34 | 0.66 | 0.007 | 0.008 | 0.37 | 0.19 | 0.001 | 0.001 | 0.0003 | 0.0002 | 0.0047 | 0.0009 |
| Inv. ex. | 58 | 0.65 | 1.41 | 0.79 | 0.007 | 0.003 | 0.18 | 0.17 | 0.002 | 0.002 | 0.0003 | 0.0003 | 0.0039 | 0.0016 |
| Inv. ex. | 59 | 0.67 | 1.82 | 0.45 | 0.007 | 0.004 | 0.86 | 0.19 | 0.002 | 0.003 | 0.0003 | 0.0001 | 0.0051 | 0.0016 |
| Inv. ex. | 60 | 0.66 | 2.19 | 0.68 | 0.004 | 0.006 | 0.75 | 0.18 | 0.003 | 0.003 | 0.0003 | 0.0001 | 0.0047 | 0.0018 |

TABLE 2-continued

| Ex. | Chemical ingredient | | | | | | | | | | |
|---|---|---|---|---|---|---|---|---|---|---|---|
| | Mo | V | Nb | Ni | Cu | Co | B | Ca | Hf | Te | Sb |
| Inv. ex. | 0.09 | 0.23 | — | — | — | — | — | — | — | — | — |
| Inv. ex. | 0.12 | 0.24 | — | — | — | — | — | — | — | — | — |
| Inv. ex. | 0.18 | 0.25 | — | — | — | — | — | — | — | — | — |
| Inv. ex. | 0.20 | 0.21 | — | — | — | — | — | — | — | — | — |
| Inv. ex. | 0.15 | 0.14 | — | — | — | — | — | — | — | — | — |
| Inv. ex. | 0.20 | 0.14 | — | — | — | — | — | — | — | — | — |
| Inv. ex. | — | 0.08 | — | — | — | — | — | — | — | — | — |
| Inv. ex. | — | — | — | — | — | — | — | — | — | — | — |
| Inv. ex. | 0.10 | — | — | — | — | — | — | — | — | — | — |
| Inv. ex. | 0.24 | 0.15 | — | — | — | — | — | — | — | — | — |
| Inv. ex. | 0.22 | 0.10 | — | — | — | — | — | — | — | — | — |
| Inv. ex. | 0.17 | 0.14 | — | — | — | — | — | — | — | — | — |
| Inv. ex. | 0.18 | 0.14 | — | — | — | — | — | — | — | — | — |
| Inv. ex. | 0.19 | 0.10 | — | — | — | — | — | — | — | — | — |
| Inv. ex. | 0.21 | 0.16 | — | — | — | — | — | — | — | — | — |
| Inv. ex. | 0.24 | 0.12 | — | — | — | — | — | — | — | — | — |
| Inv. ex. | 0.17 | 0.20 | — | — | — | — | — | — | — | — | — |
| Inv. ex. | 0.13 | 0.13 | — | — | — | — | — | — | — | — | — |
| Inv. ex. | 0.18 | 0.13 | — | — | — | — | — | — | — | — | — |
| Inv. ex. | 0.17 | 0.21 | — | — | — | — | — | — | — | — | — |
| Inv. ex. | 0.11 | 0.24 | — | — | — | — | — | — | — | — | — |
| Inv. ex. | 0.21 | 0.22 | 0.025 | — | — | — | — | — | — | — | — |
| Inv. ex. | 0.09 | 0.13 | — | 0.56 | — | — | — | — | — | — | — |
| Inv. ex. | 0.24 | 0.12 | — | — | 0.2 | — | — | — | — | — | — |
| Inv. ex. | 0.11 | 0.09 | — | — | — | 0.34 | — | — | — | — | — |
| Inv. ex. | 0.13 | 0.17 | — | — | — | — | 0.0011 | — | — | — | — |
| Inv. ex. | 0.23 | 0.14 | — | — | — | — | — | 0.0002 | — | — | — |
| Inv. ex. | 0.10 | 0.24 | — | — | — | — | — | — | 0.0012 | — | — |
| Inv. ex. | 0.17 | 0.15 | — | — | — | — | — | — | — | 0.0011 | — |
| Inv. ex. | 0.09 | 0.22 | — | — | — | — | — | — | — | — | 0.0011 |

TABLE 3

| Ex. | Chemical ingredients | | | | | | | | | | | |
|---|---|---|---|---|---|---|---|---|---|---|---|---|
| | No | C | Si | Mn | P | S | Cr | W | Ti | Al | Zr | Mg |
| Comp. ex. | 61 | 0.55 | 1.64 | 0.52 | 0.002 | 0.003 | 1.46 | — | 0.002 | 0.001 | 0.0001 | 0.0004 |
| Comp. ex. | 62 | 0.61 | 1.60 | 0.79 | 0.005 | 0.008 | 0.84 | — | 0.003 | 0.003 | 0.0002 | 0.0003 |
| Comp. ex. | 63 | 0.68 | 1.83 | 1.01 | 0.001 | 0.009 | 0.37 | — | 0.001 | 0.002 | 0.0003 | 0.0002 |
| Comp. ex. | 64 | 0.67 | 2.64 | 0.75 | 0.001 | 0.003 | 0.64 | 0.21 | 0.002 | 0.012 | 0.0003 | 0.0005 |
| Comp. ex. | 65 | 0.69 | 2.26 | 0.83 | 0.004 | 0.006 | 0.49 | 0.15 | 0.001 | 0.021 | 0.0001 | 0.0001 |
| Comp. ex. | 66 | 0.68 | 2.17 | 0.94 | 0.012 | 0.002 | 0.75 | 0.21 | 0.001 | 0.001 | 0.021 | 0.0004 |
| Comp. ex. | 67 | 0.66 | 1.22 | 1.00 | 0.006 | 0.006 | 1.47 | 0.21 | 0.003 | 0.002 | 0.0032 | 0.0003 |
| Comp. ex. | 68 | 0.68 | 2.55 | 1.15 | 0.007 | 0.007 | 1.16 | 0.20 | 0.001 | 0.001 | 0.0022 | 0.0001 |
| Comp. ex. | 69 | 0.69 | 2.34 | 0.87 | 0.003 | 0.005 | 0.23 | 0.19 | 0.003 | <0.001 | <0.0001 | 0.0002 |
| Comp. ex. | 70 | 0.67 | 2.48 | 0.62 | 0.007 | 0.007 | 1.19 | 0.15 | 0.001 | 0.002 | <0.0001 | 0.0001 |
| Comp. ex. | 71 | 0.70 | 2.02 | 0.35 | 0.010 | 0.002 | 1.25 | 0.16 | 0.003 | 0.001 | <0.0001 | 0.0004 |
| Comp. ex. | 72 | 0.65 | 2.12 | 0.50 | 0.003 | 0.006 | 0.75 | 0.18 | 0.015 | 0.002 | 0.0002 | 0.0027 |
| Comp. ex. | 73 | 0.66 | 1.69 | 0.51 | 0.006 | 0.002 | 0.54 | 0.17 | 0.025 | 0.002 | 0.0003 | 0.0004 |
| Comp. ex. | 74 | 0.66 | 1.50 | 1.10 | 0.007 | 0.004 | 1.35 | 0.21 | 0.002 | 0.012 | 0.0002 | 0.0012 |
| Comp. ex. | 75 | 0.68 | 1.81 | 1.12 | 0.005 | 0.004 | 0.59 | 0.14 | 0.003 | 0.001 | 0.0026 | 0.0002 |
| Comp. ex. | 76 | 0.42 | 1.64 | 0.52 | 0.002 | 0.003 | 1.46 | — | 0.002 | 0.001 | 0.0001 | 0.0004 |
| Comp. ex. | 77 | 0.41 | 1.25 | 0.62 | 0.004 | 0.009 | 0.83 | 0.15 | 0.002 | 0.002 | 0.0002 | 0.0002 |
| Comp. ex. | 78 | 0.75 | 2.54 | 1.15 | 0.004 | 0.008 | 0.46 | 0.16 | 0.002 | 0.004 | 0.0003 | 0.0002 |
| Comp. ex. | 79 | 0.85 | 2.34 | 0.87 | 0.008 | 0.007 | 0.56 | 0.15 | 0.003 | 0.001 | 0.0001 | 0.0001 |

| Ex. | Chemical ingredients | | | | | | | | | | | | |
|---|---|---|---|---|---|---|---|---|---|---|---|---|---|
| | N | t-O | Mo | V | Nb | Ni | Cu | Co | B | Ca | Hf | Te | Sb |
| Comp. ex. | 0.0042 | 0.0019 | 0.11 | 0.12 | — | — | — | — | — | — | — | — | — |
| Comp. ex. | 0.0043 | 0.0011 | 0.11 | 0.12 | — | — | — | — | — | — | — | — | — |
| Comp. ex. | 0.0028 | 0.0013 | 0.12 | 0.10 | — | — | — | — | — | — | — | — | — |
| Comp. ex. | 0.0054 | 0.0017 | 0.14 | 0.12 | — | — | — | — | — | — | — | — | — |
| Comp. ex. | 0.0057 | 0.0019 | 0.17 | 0.24 | — | — | — | — | — | — | — | — | — |
| Comp. ex. | 0.0035 | 0.0009 | 0.21 | 0.24 | — | — | — | — | — | — | — | — | — |
| Comp. ex. | 0.0044 | 0.0012 | 0.14 | 0.19 | — | — | — | — | — | — | — | — | — |
| Comp. ex. | 0.0057 | 0.0017 | 0.22 | 0.11 | — | — | — | — | — | — | — | — | — |
| Comp. ex. | 0.0055 | 0.0014 | 0.23 | 0.14 | — | — | — | — | — | — | — | — | — |
| Comp. ex. | 0.0026 | 0.0010 | 0.09 | 0.22 | — | — | — | — | — | — | — | — | — |
| Comp. ex. | 0.0059 | 0.0019 | 0.18 | 0.13 | — | — | — | — | — | — | — | — | — |
| Comp. ex. | 0.0045 | 0.0014 | 0.09 | 0.17 | — | — | — | — | — | — | — | — | — |

TABLE 3-continued

| | | | | | | | | | | | | | |
|---|---|---|---|---|---|---|---|---|---|---|---|---|---|
| Comp. ex. | 0.0053 | 0.0017 | 0.19 | 0.19 | — | — | — | — | — | — | — | — | — |
| Comp. ex. | 0.0033 | 0.0018 | 0.11 | 0.14 | — | — | — | — | — | — | — | — | — |
| Comp. ex. | 0.0041 | 0.0015 | 0.15 | 0.17 | — | — | — | — | — | 0.0025 | — | — | — |
| Comp. ex. | 0.0045 | 0.0014 | — | — | — | — | — | — | — | — | — | — | — |
| Comp. ex. | 0.0043 | 0.0011 | 0.17 | 0.12 | — | — | — | — | — | — | — | — | — |
| Comp. ex. | 0.0028 | 0.0016 | 0.19 | 0.13 | — | — | — | — | — | — | — | — | — |
| Comp. ex. | 0.0053 | 0.0017 | 0.19 | 0.13 | — | — | — | — | — | — | — | — | — |

TABLE 4

| Example | No | Melting method | Tensile strength MPa | Tensile elongation % | After annealing HV | Rotational bending MPa |
|---|---|---|---|---|---|---|
| Inv. ex. | 1 | 150 kg | 2320 | 11.4 | 590 | 853 |
| Inv. ex. | 2 | 150 kg | 2313 | 8.7 | 602 | 872 |
| Inv. ex. | 3 | 150 kg | 2338 | 11.0 | 600 | 862 |
| Inv. ex. | 4 | 150 kg | 2270 | 7.1 | 617 | 902 |
| Inv. ex. | 5 | 150 kg | 2282 | 8.2 | 609 | 892 |
| Inv. ex. | 6 | 150 kg | 2382 | 10.9 | 595 | 862 |
| Inv. ex. | 7 | 2 t | 2333 | 8.7 | 590 | 853 |
| Inv. ex. | 8 | 2 t | 2272 | 7.5 | 617 | 892 |
| Inv. ex. | 9 | 2 t | 2347 | 11.5 | 597 | 872 |
| Inv. ex. | 10 | 150 kg | 2328 | 7.9 | 606 | 872 |
| Inv. ex. | 11 | 2 t | 2325 | 10.4 | 599 | 882 |
| Inv. ex. | 12 | 2 t | 2357 | 7.0 | 595 | 862 |
| Inv. ex. | 13 | 2 t | 2378 | 10.6 | 617 | 892 |
| Inv. ex. | 14 | 2 t | 2359 | 11.4 | 598 | 872 |
| Inv. ex. | 15 | 150 kg | 2369 | 8.2 | 604 | 882 |
| Inv. ex. | 16 | 150 kg | 2337 | 7.2 | 593 | 862 |
| Inv. ex. | 17 | 2 t | 2351 | 10.7 | 589 | 862 |
| Inv. ex. | 18 | 150 kg | 2307 | 7.2 | 595 | 862 |
| Inv. ex. | 19 | 150 kg | 2315 | 10.0 | 618 | 892 |
| Inv. ex. | 20 | 150 kg | 2342 | 8.3 | 611 | 892 |
| Inv. ex. | 21 | 150 kg | 2289 | 8.6 | 603 | 882 |
| Inv. ex. | 22 | 150 kg | 2301 | 8.5 | 599 | 872 |
| Inv. ex. | 23 | 10 kg | 2341 | 9.3 | 594 | 872 |
| Inv. ex. | 23 | 150 kg | 2332 | 10.7 | 592 | 862 |
| Inv. ex. | 23 | 150 kg | 2345 | 11.1 | 602 | 872 |
| Inv. ex. | 24 | 10 kg | 2322 | 7.8 | 598 | 872 |
| Inv. ex. | 25 | 10 kg | 2294 | 9.6 | 601 | 882 |
| Inv. ex. | 26 | 10 kg | 2313 | 10.7 | 607 | 872 |
| Inv. ex. | 27 | 10 kg | 2304 | 11.0 | 598 | 872 |
| Inv. ex. | 28 | 10 kg | 2321 | 9.0 | 591 | 872 |
| Inv. ex. | 29 | 10 kg | 2346 | 10.8 | 601 | 872 |
| Inv. ex. | 30 | 10 kg | 2331 | 9.6 | 595 | 862 |

TABLE 5

| Example | No | Melting method | Tensile strength MPa | Tensile elongation % | After annealing HV | Rotational bending MPa |
|---|---|---|---|---|---|---|
| Inv. ex. | 31 | 10 kg | 2283 | 8.5 | 608 | 882 |
| Inv. ex. | 32 | 10 kg | 2268 | 10.2 | 599 | 862 |
| Inv. ex. | 33 | 200 t | 2329 | 8.0 | 598 | 872 |
| Inv. ex. | 34 | 2 t | 2282 | 11.8 | 594 | 862 |
| Inv. ex. | 35 | 150 kg | 2315 | 9.4 | 612 | 892 |
| Inv. ex. | 36 | 150 kg | 2275 | 8.6 | 608 | 882 |
| Inv. ex. | 37 | 2 t | 2370 | 7.2 | 610 | 892 |
| Inv. ex. | 38 | 150 kg | 2327 | 10.2 | 615 | 892 |
| Inv. ex. | 39 | 150 kg | 2337 | 7.7 | 605 | 882 |
| Inv. ex. | 40 | 150 kg | 2302 | 7.1 | 612 | 882 |
| Inv. ex. | 41 | 150 kg | 2319 | 9.3 | 596 | 862 |
| Inv. ex. | 42 | 150 kg | 2346 | 7.7 | 588 | 853 |
| Inv. ex. | 43 | 150 kg | 2337 | 10.9 | 596 | 862 |
| Inv. ex. | 44 | 150 kg | 2289 | 10.6 | 588 | 862 |
| Inv. ex. | 45 | 150 kg | 2313 | 11.3 | 616 | 892 |
| Inv. ex. | 46 | 150 kg | 2341 | 9.9 | 589 | 853 |
| Inv. ex. | 47 | 150 kg | 2340 | 8.1 | 617 | 892 |
| Inv. ex. | 48 | 150 kg | 2341 | 9.3 | 590 | 853 |
| Inv. ex. | 49 | 150 kg | 2319 | 7.6 | 606 | 872 |
| Inv. ex. | 50 | 150 kg | 2305 | 8.4 | 611 | 882 |
| Inv. ex. | 51 | 10 kg | 2279 | 9.6 | 600 | 872 |
| Inv. ex. | 52 | 10 kg | 2343 | 8.6 | 600 | 872 |

TABLE 5-continued

| Example | No | Melting method | Tensile strength MPa | Tensile elongation % | After annealing HV | Rotational bending MPa |
|---|---|---|---|---|---|---|
| Inv. ex. | 53 | 10 kg | 2331 | 7.8 | 588 | 853 |
| Inv. ex. | 54 | 10 kg | 2316 | 11.5 | 595 | 862 |
| Inv. ex. | 55 | 10 kg | 2340 | 11.1 | 595 | 872 |
| Inv. ex. | 56 | 10 kg | 2287 | 11.0 | 603 | 872 |
| Inv. ex. | 57 | 10 kg | 2294 | 9.9 | 590 | 853 |
| Inv. ex. | 58 | 10 kg | 2315 | 8.2 | 601 | 862 |
| Inv. ex. | 59 | 10 kg | 2307 | 9.9 | 589 | 853 |
| Inv. ex. | 60 | 10 kg | 2310 | 10.6 | 597 | 862 |

TABLE 6

| Example | No | Melting method | Tensile strength MPa | Tensile elongation % | After annealing HV | Rotational bending MPa |
|---|---|---|---|---|---|---|
| Comp. ex. | 61 | 2 t | 2148 | 12.3 | 538 | 813 |
| Comp. ex. | 62 | 270 t | 2287 | 11.3 | 545 | 823 |
| Comp. ex. | 63 | 2 t | 2322 | 11.0 | 548 | 813 |
| Comp. ex. | 64 | 2 t | 2362 | 1.4 | 613 | 843 |
| Comp. ex. | 65 | 2 t | 2324 | 10.2 | 600 | 823 |
| Comp. ex. | 66 | 2 t | 2333 | 2.3 | 613 | 833 |
| Comp. ex. | 67 | 150 kg | 2332 | 3.0 | 605 | 833 |
| Comp. ex. | 68 | 150 kg | 2319 | 2.2 | 599 | 823 |
| Comp. ex. | 69 | 2 t | 2293 | 6.2 | 611 | 882 |
| Comp. ex. | 70 | 2 t | 2325 | 1.7 | 592 | 872 |
| Comp. ex. | 71 | 2 t | 2330 | 3.0 | 589 | 862 |
| Comp. ex. | 72 | 2 t | 2274 | 8.0 | 595 | 813 |
| Comp. ex. | 73 | 2 t | 2292 | 9.0 | 609 | 833 |
| Comp. ex. | 74 | 2 t | 2281 | 7.7 | 608 | 823 |
| Comp. ex. | 75 | 150 kg | 2272 | 9.5 | 595 | 813 |
| Comp. ex. | 76 | 2 t | 2106 | 7.1 | 512 | 756 |
| Comp. ex. | 77 | 2 t | 2150 | 11.4 | 526 | 786 |
| Comp. ex. | 78 | 2 t | 2393 | 1.9 | 596 | 813 |
| Comp. ex. | 79 | 2 t | 2370 | 2.2 | 609 | 833 |

Example 2

The chemical ingredients of the present invention and the comparative steel in the case when treated at ϕ4 mm are shown in Tables 7 to 9. The area ratio of the cementite-based carbide poor regions, the occupied area ratio of the alloy-based/cementite-based spherical carbides, the density of presence of cementite-based spherical carbides having a circle equivalent diameter of 0.2 to 3 μm, the density of presence of cementite-based spherical carbides having a circle equivalent diameter of over 3 μm, the prior austenite grain size number, the amount of residual austenite (mass %), the tensile strength, the coiling characteristic (tensile elongation), and the average fatigue strength are shown in Tables 10 to 12.

Method of Production of Samples (Wire Rod)

In Invention Example 1 of the present invention, the material was refined by a 250 ton converter and continuously cast to billet. Further, in the other examples, the material was melted in a 2 ton vacuum melting furnace, then rolled to a billet. At that time, in the invention examples, the material was held at a 1200° C. or more high temperature for a certain time. After this, in each case, the billet was rolled to ϕ8 mm.

Drawing of Samples

The rolling wire material was drawn to ϕ4 mm. At that time, the material was patented before drawing to obtain an easily drawn structure. At this time, it is preferable to heat the material to 900° C. or more so that the carbides sufficiently dissolve. The examples of the invention were heated at 930 to 950° C. for patenting. On the other hand, Comparative Examples 68 and 69 were patented by heating at the conventional 890° C. and then drawn.

Method of Production of Samples (OT, IQT-Wire)

With quenching and tempering (oil tempering), the drawn wire material was passed through a heating furnace. Simulating this, the time of passage through the heating furnace was set so that the inside of the steel was heated to a sufficient temperature. In this example, the quenching using a radiant furnace was performed at a heating temperature of 950° C., a heating time of 300 seconds, and a quenching temperature of 50° C. (actually measured temperature of oil tank). The cooling time was also held for a long 5 minutes or more. Further, the tempering was performed at a tempering temperature of 400 to 500° C. and using a lead tank for a tempering time of 3 minutes to adjust the strength. As a result, the obtained tensile strength in the obtained atmosphere was as clearly indicated in Table 11.

Further, when using high frequency heating, the heating temperature was 1000° C., the heating time was 15 seconds, and the quenching was by water cooling. The tempering temperature was adjusted to give a strength of 2250 MPa or more.

The amount of carbides and strength differ depending on the chemical ingredients, so in the present invention the heat treatment was performed in accordance with the chemical ingredients as to obtain a tensile strength of 2100 MPa or so and satisfy the prescribed ranges in the claims. On the other hand, in the comparative examples, the heat treatment was performed so as to simply meet with the tensile strength. In each case, shot peening was used to remove the scale before use of the sample for the tests.

Method of Evaluation of Microstructure

The dimensions and number of the carbides were evaluated by polishing the steel wire as heat treated in the longitudinal direction to a mirror surface and etching it slightly by picric acid to expose the carbides. At the optical microscope level, measurement of the dimensions of the carbides is difficult, so ½R parts of the steel wire were randomly photographed at 10 fields by a scan type electron microscope at a power of X5000. An X-ray microanalyzer attached to a scan type electron microscope was used to confirm that the spherical carbides were cementite-based spherical carbides. From the photographs, the spherical carbides were digitalized using an image processing system and the dimensions, number, and occupied area were measured. The total measurement area was 3088.8 $\mu m^2$.

Tension and Fatigue (Rotational Bending)

The tensile characteristics were evaluated using JIS Z 2201 No. 9 test pieces based on JIS Z 2241. The tensile strength was calculated from the breakage load. The tensile strength is known to be directly linked with the fatigue durability property of heat treated steel wire. Within a range not impairing the coiling and other workability, a higher tensile strength is preferable.

The notch bending test was performed by the method of Example 1.

The fatigue test was a Nakamura type rotational bending fatigue test. The samples were cleaned of heat treatment scale on their surfaces, then used for the test. The maximum load stress where 10 samples exhibited a lifetime of $10^7$ cycles or more at a 50% or higher probability was defined as the average fatigue strength.

As shown in Tables 7 to 12, with ϕ4 mm steel wire, if the chemical ingredients become outside the prescribed ranges, control of the carbides becomes difficult. As seen in the elongation in a tensile test, which is an indicator of the coilability, the deformation characteristic and therefore the coiling characteristic deteriorates, the tensile strength is reduced, and further the fatigue strength becomes inferior in some cases. Further, comparative materials where even if the chemical ingredients are in the prescribed range, the maximum oxide size and prior austenite grain size are outside of the prescribed range due to stabilization of carbides by advance annealing, insufficient heating at the time of quenching and the resultant undissolved carbides remaining, insufficient cooling during quenching, or other problems in heat treatment conditions are inferior in coiling characteristics or tensile characteristics and fatigue characteristics. On the other hand, even if the prescribed range of the carbides is satisfied, if the strength is insufficient, the fatigue strength will be insufficient and the material cannot be used for a high strength spring.

During the rolling, in particular at an extraction temperature of a high temperature of 1200° C. or more, by making the heating temperature during the patenting and quenching at the time of drawing 900° C. or more, undissolved carbides can be avoided. Further, to reduce the prior austenite grain size, it is possible to either make the wire running rate faster or maintain the temperature at a relatively low temperature to suppress the formation of undissolved carbides and make the austenite grain size number #10 or more. Further, at this time, to suppress the segregation of the C or other alloy element, the carbide poor region also becomes small and a good bending characteristic and tempering softening resistance and fatigue strength can be secured. When envisioning IQT (high frequency heating), the heating temperature at the time of quenching was set tens of degrees Centrigrade higher than the radiant furnace heating. Conversely, the heating time was a short time.

When heating during the rolling, patenting, and quenching are all sufficient, undissolved carbides and segregation are avoided, the austenite grain size is maintained fine, and the carbide poor regions are suppressed, both the fatigue strength and coilability can be achieved.

In the examples shown in the tables, unless indicated to the contrary, the rolling heating temperature was 1220° C., the patenting temperature was 950° C. (only Examples 7 and 18, 930° C.), and quenching was performed by heating at 940° C. when A: envisioning OT treatment (radiant furnace) and at 1000° C. when B: envisioning IQT (high frequency heating). After quenching, the tempering was performed selecting tempering conditions matching with the type of the steel to give a tensile strength of 2200 MPa or more.

The coilability was evaluated by the elongation at the tensile test. If this elongation is less than 7%, the coilability becomes difficult, so if 7% or more, it is judged that industrial spring making is possible.

Comparative Examples 48 and 49 were insufficient in amount of C and even if reduced in tempering temperature, the strength could not be secured and the fatigue strength was inferior.

In Comparative Examples 50 and 51, the heating temperature at the time of quenching was 880° C. or lower than the range of this ingredient, so a large number of undissolved carbides were seen and sufficient coilability could not be secured.

Further, in Comparative Examples 52 to 59 in which large amounts of alloy elements were added, the dissolution under normal heating was insufficient, so a large amount of undissolved carbide was seen and coilability could not be secured.

Comparative Example 60 was raised in heating temperature at the time of quenching to 1020° C., so the carbide poor regions became greater and sufficient coilability could not be secured.

Further, Examples 61 to 63 contained large amounts of C, Mn, P, and other easily segregated elements, so the carbide poor regions became large and sufficient coilability could not be secured.

In Examples 64 to 67, the rolling heating temperature was 1050° C., that is, the rolling was performed under a relatively low temperature heating, so at the stage of the rolling material, undissolved carbide remained. With further shorter time patenting, with quenching heating, the effect could not be completely eliminated, so the carbide poor regions became larger and sufficient coilability could not be secured.

In Examples 68 and 69, the patenting was deliberately performed at 890° C. and then the wire drawn, so at the quenching stage, while the material was sufficiently heated and undissolved carbides were suppressed, the austenite grain size became large, the quenched structure became uneven due to the segregation of the ingredients and the undissolved carbides, and the carbide poor regions were observed to be larger than the prescribed amount. As a result, a sufficient coiling characteristic could not be secured.

Example 70 is the case where the tempering temperature is set to 600° C. and the strength is set low. The fatigue strength was insufficient.

Examples 71 to 73 are examples of the residual austenite not being the prescribed range or more due to the carbide poor regions being small, the cooling rate not being able to be secured, or other reasons. While the austenite grain size was small, the cooling oil at the time of quenching was made 80° C. or more to deliberately increase the amount of residual austenite. As a result, the strength was insufficient and the fatigue characteristics could not be secured.

Examples 74 to 77 are cases of heating at the time of quenching at 1000° C. and suppressing the undissolved carbides, but the austenite grain size became large, so sufficient ductility could not be secured and the coilability could not be secured.

Further, Examples 78 and 79 are examples with low Si, therefore sufficient tempering softening resistance and setting characteristic could not be secured.

TABLE 7

| | Chemical ingredient | | | | | | | | | | | | | |
|---|---|---|---|---|---|---|---|---|---|---|---|---|---|---|
| Ex. | No | C | Si | Mn | P | S | Cr | Ti | V | Nb | Mo | W | Ni | Cu |
| Inv. ex. | 1 | 0.64 | 1.88 | 0.63 | 0.007 | 0.008 | 1.28 | — | 0.10 | — | — | — | — | — |
| Inv. ex. | 2 | 0.67 | 2.21 | 0.23 | 0.002 | 0.003 | 1.22 | — | 0.14 | — | — | — | — | — |
| Inv. ex. | 3 | 0.63 | 2.30 | 0.69 | 0.006 | 0.007 | 1.12 | — | 0.25 | — | — | 0.15 | — | — |
| Inv. ex. | 4 | 0.67 | 1.99 | 0.81 | 0.008 | 0.004 | 1.10 | — | 0.18 | — | 0.21 | — | — | — |
| Inv. ex. | 5 | 0.69 | 1.98 | 0.20 | 0.003 | 0.001 | 1.12 | — | 0.22 | — | — | 0.18 | — | — |
| Inv. ex. | 6 | 0.69 | 2.30 | 0.24 | 0.007 | 0.003 | — | — | — | — | 0.54 | — | — | — |
| Inv. ex. | 7 | 0.70 | 2.75 | 1.54 | 0.006 | 0.007 | — | — | — | — | — | — | — | — |
| Inv. ex. | 8 | 0.68 | 2.26 | 0.68 | 0.008 | 0.003 | — | — | 0.34 | — | — | — | — | — |
| Inv. ex. | 9 | 0.70 | 2.21 | 0.50 | 0.007 | 0.001 | — | — | — | — | — | 0.58 | — | — |
| Inv. ex. | 10 | 0.55 | 1.97 | 0.80 | 0.001 | 0.004 | 1.38 | — | 0.10 | — | 0.20 | 0.16 | — | — |
| Inv. ex. | 11 | 0.65 | 1.97 | 0.63 | 0.004 | 0.002 | 1.27 | — | 0.21 | — | 0.10 | 0.15 | — | — |
| Inv. ex. | 12 | 0.66 | 1.81 | 0.40 | 0.004 | 0.006 | 0.79 | — | 0.22 | — | 0.24 | 0.21 | — | — |
| Inv. ex. | 13 | 0.62 | 2.18 | 0.76 | 0.002 | 0.008 | 1.21 | — | — | — | 0.12 | 0.20 | — | — |
| Inv. ex. | 14 | 0.63 | 2.13 | 0.52 | 0.003 | 0.001 | 1.49 | — | 0.11 | — | 0.18 | — | — | — |
| Inv. ex. | 15 | 0.68 | 1.82 | 0.83 | 0.006 | 0.005 | 1.03 | — | 0.23 | — | 0.17 | — | — | — |
| Inv. ex. | 16 | 0.69 | 2.20 | 0.46 | 0.001 | 0.004 | 1.21 | — | 0.19 | — | 0.20 | — | — | — |
| Inv. ex. | 17 | 0.65 | 1.80 | 0.41 | 0.005 | 0.004 | 1.13 | 0.002 | 0.11 | — | 0.11 | — | — | — |
| Inv. ex. | 18 | 0.61 | 2.20 | 0.56 | 0.008 | 0.005 | 1.18 | — | 0.24 | 0.02 | 0.09 | 0.20 | — | — |
| Inv. ex. | 19 | 0.64 | 2.17 | 0.71 | 0.003 | 0.006 | 1.26 | — | — | — | 0.15 | 0.19 | 0.2 | — |
| Inv. ex. | 20 | 0.63 | 2.06 | 0.44 | 0.005 | 0.005 | 0.87 | — | 0.23 | — | 0.21 | 0.18 | — | 0.05 |
| Inv. ex. | 21 | 0.68 | 2.17 | 0.44 | 0.005 | 0.003 | — | — | 0.10 | — | 0.20 | 0.19 | — | — |
| Inv. ex. | 22 | 0.69 | 1.99 | 1.21 | 0.002 | 0.003 | 1.16 | — | 0.15 | — | 0.18 | 0.18 | — | — |
| Inv. ex. | 23 | 0.62 | 2.17 | 0.79 | 0.001 | 0.006 | 1.26 | — | 0.10 | — | 0.12 | 0.16 | — | — |
| Inv. ex. | 24 | 0.70 | 1.91 | 0.54 | 0.001 | 0.001 | 1.37 | — | 0.22 | — | 0.25 | — | — | — |

| | Chemical ingredient | | | | | | | | | | |
|---|---|---|---|---|---|---|---|---|---|---|---|
| Ex. | Co | B | Al | Ca | Zr | Hf | Te | Sb | Mg | N | t-O |
| Inv. ex. | — | — | <0.001 | — | — | — | — | — | — | 0.0045 | 0.0013 |
| Inv. ex. | — | — | <0.001 | — | — | — | — | — | — | 0.0060 | 0.0010 |
| Inv. ex. | — | — | <0.001 | — | — | — | — | — | — | 0.0036 | 0.0020 |
| Inv. ex. | — | — | 0.001 | — | 0.0003 | — | — | — | 0.0004 | 0.0046 | 0.0011 |
| Inv. ex. | — | — | <0.001 | — | — | — | — | — | 0.0005 | 0.0027 | 0.0013 |
| Inv. ex. | — | — | <0.001 | — | — | — | — | — | — | 0.0042 | 0.0016 |
| Inv. ex. | — | — | <0.001 | — | — | — | — | — | — | 0.0056 | 0.0020 |
| Inv. ex. | — | — | <0.001 | — | — | — | — | — | — | 0.0054 | 0.0020 |
| Inv. ex. | — | — | <0.001 | — | — | — | — | — | — | 0.0026 | 0.0011 |
| Inv. ex. | — | — | <0.001 | — | — | — | — | — | 0.0003 | 0.0044 | 0.0023 |
| Inv. ex. | — | — | 0.001 | — | 0.0002 | — | — | — | — | 0.0029 | 0.0015 |
| Inv. ex. | — | — | 0.002 | — | 0.0001 | — | — | — | — | 0.0047 | 0.0021 |
| Inv. ex. | — | — | 0.000 | — | 0.0002 | — | — | — | — | 0.0059 | 0.0023 |
| Inv. ex. | — | — | <0.001 | — | — | — | — | — | — | 0.0041 | 0.0012 |
| Inv. ex. | — | — | 0.003 | — | — | — | — | — | — | 0.0023 | 0.0025 |

TABLE 7-continued

| | | | | | | | | | | | |
|---|---|---|---|---|---|---|---|---|---|---|---|
| Inv. ex. | — | — | 0.003 | — | 0.0003 | — | — | — | — | 0.0045 | 0.0018 |
| Inv. ex. | — | — | <0.001 | — | — | — | — | — | — | 0.0052 | 0.0014 |
| Inv. ex. | — | — | 0.002 | — | 0.0002 | — | — | — | 0.0005 | 0.0028 | 0.0017 |
| Inv. ex. | — | — | 0.001 | — | 0.0002 | — | — | — | 0.0003 | 0.0046 | 0.0010 |
| Inv. ex. | — | — | <0.001 | — | — | — | — | — | 0.0004 | 0.0038 | 0.0022 |
| Inv. ex. | 0.18 | — | <0.001 | — | 0.0002 | — | — | — | 0.0003 | 0.0060 | 0.0022 |
| Inv. ex. | — | 0.0009 | 0.001 | — | — | — | — | — | 0.0004 | 0.0043 | 0.0014 |
| Inv. ex. | — | — | 0.002 | 0.0004 | 0.0002 | — | — | — | 0.0002 | 0.0039 | 0.0020 |
| Inv. ex. | — | — | <0.001 | — | — | 0.0005 | — | — | — | 0.0044 | 0.0015 |

TABLE 8

| | Chemical ingredient | | | | | | | | | | | | | | |
|---|---|---|---|---|---|---|---|---|---|---|---|---|---|---|---|
| Ex. | No | C | Si | Mn | P | S | Cr | Ti | V | Nb | Mo | W | Ni | Cu | Co |
| Inv. ex. | 25 | 0.63 | 1.97 | 0.90 | 0.005 | 0.006 | 1.35 | — | 0.16 | — | 0.18 | — | — | — | — |
| Inv. ex. | 26 | 0.63 | 2.27 | 0.81 | 0.007 | 0.004 | 1.11 | — | 0.15 | — | 0.16 | 0.15 | — | — | — |
| Inv. ex. | 27 | 0.68 | 2.13 | 0.30 | 0.004 | 0.003 | 1.49 | — | 0.12 | — | 0.11 | 0.22 | — | — | — |
| Inv. ex. | 28 | 0.64 | 2.15 | 0.16 | 0.001 | 0.007 | 1.22 | — | 0.16 | — | 0.23 | 0.18 | — | — | — |
| Inv. ex. | 29 | 0.69 | 2.04 | 0.14 | 0.002 | 0.008 | 1.22 | — | 0.16 | — | 0.23 | 0.21 | — | — | — |
| Inv. ex. | 30 | 0.68 | 2.16 | 0.16 | 0.006 | 0.002 | 1.24 | — | 0.21 | — | 0.08 | 0.17 | — | — | — |
| Inv. ex. | 31 | 0.56 | 1.87 | 0.35 | 0.003 | 0.006 | 1.38 | — | 0.19 | — | 0.24 | 0.15 | — | — | — |
| Inv. ex. | 32 | 0.67 | 2.29 | 0.27 | 0.003 | 0.005 | 1.21 | — | 0.20 | — | 0.17 | 0.19 | — | — | — |
| Inv. ex. | 33 | 0.64 | 2.04 | 0.13 | 0.007 | 0.005 | 0.79 | — | 0.18 | — | 0.20 | 0.16 | — | — | — |
| Inv. ex. | 34 | 0.69 | 2.08 | 0.11 | 0.007 | 0.002 | 1.25 | — | — | — | 0.22 | 0.20 | — | — | — |
| Inv. ex. | 35 | 0.66 | 2.03 | 0.23 | 0.002 | 0.006 | 1.11 | — | 0.09 | — | 0.10 | 0.14 | — | — | — |
| Inv. ex. | 36 | 0.61 | 2.05 | 0.30 | 0.008 | 0.005 | 1.35 | — | 0.20 | — | 0.09 | 0.16 | — | — | — |
| Inv. ex. | 37 | 0.68 | 2.10 | 0.31 | 0.004 | 0.003 | 1.29 | — | 0.19 | — | 0.19 | 0.22 | — | — | — |
| Inv. ex. | 38 | 0.61 | 2.15 | 0.16 | 0.002 | 0.009 | 1.36 | 0.002 | 0.23 | — | 0.09 | 0.19 | — | — | — |
| Inv. ex. | 39 | 0.67 | 2.25 | 0.15 | 0.001 | 0.004 | 1.35 | — | — | 0.03 | — | 0.16 | — | — | — |
| Inv. ex. | 40 | 0.66 | 2.04 | 0.35 | 0.004 | 0.005 | 1.27 | — | 0.11 | — | 0.15 | 0.15 | 0.2 | — | — |
| Inv. ex. | 41 | 0.65 | 2.24 | 0.34 | 0.005 | 0.004 | 1.20 | — | 0.17 | — | 0.23 | 0.18 | — | 0.07 | — |
| Inv. ex. | 42 | 0.65 | 1.95 | 0.32 | 0.009 | 0.004 | 1.41 | — | 0.15 | — | — | 0.22 | — | — | 0.15 |
| Inv. ex. | 43 | 0.63 | 2.23 | 0.21 | 0.001 | 0.003 | 1.10 | — | — | — | — | 0.16 | — | — | — |
| Inv. ex. | 44 | 0.69 | 2.07 | 0.23 | 0.008 | 0.005 | 1.13 | — | 0.16 | — | 0.22 | 0.15 | — | — | — |
| Inv. ex. | 45 | 0.68 | 2.27 | 0.20 | 0.006 | 0.006 | 1.49 | — | 0.20 | — | 0.21 | 0.15 | — | — | — |
| Inv. ex. | 46 | 0.70 | 2.00 | 0.30 | 0.002 | 0.003 | 1.28 | — | 0.10 | — | — | — | — | — | — |
| Inv. ex. | 47 | 0.62 | 2.09 | 0.31 | 0.002 | 0.008 | 1.11 | — | 0.22 | — | 0.13 | 0.15 | — | — | — |

| | Chemical ingredient | | | | | | | | | |
|---|---|---|---|---|---|---|---|---|---|---|
| Ex. | B | Al | Ca | Zr | Hf | Te | Sb | Mg | N | t-O |
| Inv. ex. | — | <0.001 | — | — | — | 0.001 | — | — | 0.0046 | 0.0012 |
| Inv. ex. | — | 0.002 | — | 0.0002 | — | | 0.0008 | 0.0003 | 0.0021 | 0.0023 |
| Inv. ex. | — | <0.001 | — | 0.0003 | — | — | — | 0.0005 | 0.0027 | 0.0024 |
| Inv. ex. | — | <0.001 | — | 0.0003 | — | — | — | 0.0003 | 0.0020 | 0.0025 |
| Inv. ex. | — | 0.001 | — | 0.0003 | — | — | — | 0.0003 | 0.0044 | 0.0022 |
| Inv. ex. | — | <0.001 | — | — | — | — | — | — | 0.0026 | 0.0020 |
| Inv. ex. | — | 0.003 | — | 0.0002 | — | — | — | 0.0003 | 0.0022 | 0.0010 |
| Inv. ex. | — | <0.001 | — | — | — | — | — | 0.0004 | 0.0031 | 0.0017 |
| Inv. ex. | — | 0.003 | — | — | — | — | — | 0.0005 | 0.0044 | 0.0022 |
| Inv. ex. | — | 0.000 | — | 0.0002 | — | — | — | 0.0003 | 0.0021 | 0.0010 |
| Inv. ex. | — | <0.001 | — | 0.0002 | — | — | — | 0.0004 | 0.0027 | 0.0024 |
| Inv. ex. | — | 0.002 | — | — | — | — | — | 0.0002 | 0.0025 | 0.0016 |
| Inv. ex. | — | 0.001 | — | 0.0001 | — | — | — | — | 0.0027 | 0.0022 |
| Inv. ex. | — | <0.001 | — | 0.0001 | — | — | — | 0.0003 | 0.0034 | 0.0016 |
| Inv. ex. | — | <0.001 | — | 0.0002 | — | — | — | 0.0003 | 0.0045 | 0.0010 |
| Inv. ex. | — | 0.002 | — | 0.0003 | — | — | — | — | 0.0046 | 0.0011 |
| Inv. ex. | — | 0.001 | — | 0.0001 | — | — | — | — | 0.0026 | 0.0016 |
| Inv. ex. | — | <0.001 | — | 0.0002 | — | — | — | — | 0.0039 | 0.0020 |
| Inv. ex. | 0.0006 | <0.001 | — | — | — | — | — | — | 0.0036 | 0.0023 |
| Inv. ex. | — | 0.001 | 0.0005 | 0.0002 | — | — | — | 0.0004 | 0.0039 | 0.0014 |
| Inv. ex. | — | 0.002 | — | 0.0003 | 0.0005 | — | — | 0.0003 | 0.0040 | 0.0021 |
| Inv. ex. | — | <0.001 | — | — | — | 0.002 | — | — | 0.0041 | 0.0023 |
| Inv. ex. | — | 0.002 | — | — | — | — | 0.001 | 0.0005 | 0.0024 | 0.0023 |

TABLE 9

| Ex. | No | Chemical ingredient C | Si | Mn | P | S | Cr | Ti | V | Nb | Mo | W |
|---|---|---|---|---|---|---|---|---|---|---|---|---|
| Comp. ex. | 48 | 0.38 | 1.28 | 0.67 | 0.011 | 0.001 | 0.74 | — | — | — | — | — |
| Comp. ex. | 49 | 0.38 | 1.25 | 0.28 | 0.001 | 0.006 | 0.84 | — | — | — | — | — |
| Comp. ex. | 50 | 0.68 | 1.94 | 0.95 | 0.007 | 0.002 | 0.86 | — | — | — | — | — |
| Comp. ex. | 51 | 0.64 | 1.87 | 0.48 | 0.004 | 0.007 | 0.70 | — | — | — | — | — |
| Comp. ex. | 52 | 0.62 | 1.71 | 0.66 | 0.008 | 0.002 | 0.81 | — | 0.51 | — | — | — |
| Comp. ex. | 53 | 0.65 | 1.73 | 1.07 | 0.005 | 0.002 | 0.76 | — | — | 0.07 | — | — |
| Comp. ex. | 54 | 0.70 | 1.47 | 0.90 | 0.005 | 0.005 | 0.91 | 0.07 | — | — | — | — |
| Comp. ex. | 55 | 0.63 | 2.67 | 1.14 | 0.009 | 0.011 | 1.60 | — | 0.33 | — | — | — |
| Comp. ex. | 56 | 0.63 | 2.05 | 0.24 | 0.009 | 0.005 | 0.67 | — | 0.55 | — | — | — |
| Comp. ex. | 57 | 0.68 | 2.18 | 0.23 | 0.002 | 0.005 | 1.01 | 0.11 | — | — | — | — |
| Comp. ex. | 58 | 0.63 | 1.77 | 0.16 | 0.012 | 0.003 | 0.88 | — | — | 0.07 | — | — |
| Comp. ex. | 59 | 0.62 | 2.14 | 0.24 | 0.004 | 0.004 | 2.70 | — | — | — | — | — |
| Comp. ex. | 60 | 0.64 | 2.20 | 0.84 | 0.010 | 0.006 | 1.03 | — | — | — | — | — |
| Comp. ex. | 61 | 0.85 | 1.56 | 0.49 | 0.008 | 0.004 | 1.09 | — | — | — | — | — |
| Comp. ex. | 62 | 0.63 | 1.71 | 2.15 | 0.002 | 0.005 | 0.36 | — | — | — | — | — |
| Comp. ex. | 63 | 0.68 | 1.51 | 0.96 | 0.018 | 0.009 | 0.85 | — | — | — | — | — |
| Comp. ex. | 64 | 0.64 | 0.85 | 0.47 | 0.003 | 0.004 | 0.91 | — | — | — | — | — |
| Comp. ex. | 65 | 0.62 | 0.90 | 0.16 | 0.003 | 0.008 | 0.90 | — | — | — | — | — |
| Comp. ex. | 66 | 0.67 | 2.66 | 0.79 | 0.007 | 0.003 | 1.09 | — | 0.35 | — | — | — |
| Comp. ex. | 67 | 0.63 | 1.33 | 1.12 | 0.008 | 0.008 | 0.99 | — | — | — | — | — |
| Comp. ex. | 68 | 0.66 | 1.31 | 0.84 | 0.010 | 0.006 | 0.60 | — | 0.31 | — | — | — |
| Comp. ex. | 69 | 0.63 | 2.37 | 0.49 | 0.002 | 0.003 | 0.99 | — | — | — | — | — |
| Comp. ex. | 70 | 0.62 | 2.04 | 1.19 | 0.010 | 0.010 | 0.94 | — | — | — | — | — |
| Comp. ex. | 71 | 0.62 | 1.79 | 0.69 | 0.010 | 0.009 | 0.84 | — | — | — | — | — |
| Comp. ex. | 72 | 0.64 | 2.45 | 1.18 | 0.009 | 0.002 | 0.99 | — | — | — | — | — |
| Comp. ex. | 73 | 0.64 | 1.96 | 0.23 | 0.003 | 0.007 | 1.07 | — | — | — | — | — |
| Comp. ex. | 74 | 0.66 | 1.45 | 0.43 | 0.007 | 0.007 | 1.01 | — | — | — | — | — |
| Comp. ex. | 75 | 0.68 | 1.58 | 0.83 | 0.005 | 0.004 | 0.83 | — | — | — | — | — |
| Comp. ex. | 76 | 0.67 | 2.22 | 0.17 | 0.010 | 0.003 | 0.68 | — | — | — | — | — |
| Comp. ex. | 77 | 0.68 | 1.43 | 0.30 | 0.011 | 0.010 | 0.75 | — | — | — | — | — |
| Comp. ex. | 78 | 0.66 | 0.85 | 1.17 | 0.011 | 0.011 | 0.78 | — | — | — | — | — |
| Comp. ex. | 79 | 0.69 | 0.90 | 0.27 | 0.002 | 0.011 | 0.91 | — | — | — | — | — |

| Ex. | Chemical ingredient Ni | Cu | Co | B | Al | Ca | Zr | Hf | Te | Sb | Mg | N | t-O |
|---|---|---|---|---|---|---|---|---|---|---|---|---|---|
| Comp. ex. | — | — | — | — | <0.001 | — | — | — | — | — | — | 0.0050 | 0.0016 |
| Comp. ex. | — | — | — | — | <0.001 | — | — | — | — | — | — | 0.0033 | 0.0018 |
| Comp. ex. | — | — | — | — | <0.001 | — | — | — | — | — | — | 0.0043 | 0.0016 |
| Comp. ex. | — | — | — | — | <0.001 | — | — | — | — | — | — | 0.0029 | 0.0024 |
| Comp. ex. | — | — | — | — | <0.001 | — | — | — | — | — | — | 0.0035 | 0.0018 |
| Comp. ex. | — | — | — | — | <0.001 | — | — | — | — | — | — | 0.0051 | 0.0013 |
| Comp. ex. | — | — | — | — | <0.001 | — | — | — | — | — | — | 0.0155 | 0.0016 |
| Comp. ex. | — | — | — | — | <0.001 | — | — | — | — | — | — | 0.0095 | 0.0010 |
| Comp. ex. | — | — | — | — | <0.001 | — | — | — | — | — | — | 0.0031 | 0.0024 |
| Comp. ex. | — | — | — | — | <0.001 | — | — | — | — | — | — | 0.0025 | 0.0011 |
| Comp. ex. | — | — | — | — | <0.001 | — | — | — | — | — | — | 0.0048 | 0.0019 |
| Comp. ex. | — | — | — | — | <0.001 | — | — | — | — | — | — | 0.0036 | 0.0012 |
| Comp. ex. | — | — | — | — | <0.001 | — | — | — | — | — | — | 0.0034 | 0.0011 |
| Comp. ex. | — | — | — | — | <0.001 | — | — | — | — | — | — | 0.0029 | 0.0010 |
| Comp. ex. | — | — | — | — | <0.001 | — | — | — | — | — | — | 0.0050 | 0.0023 |
| Comp. ex. | — | — | — | — | <0.001 | — | — | — | — | — | — | 0.0042 | 0.0019 |
| Comp. ex. | — | — | — | — | <0.001 | — | — | — | — | — | — | 0.0027 | 0.0017 |
| Comp. ex. | — | — | — | — | <0.001 | — | — | — | — | — | — | 0.0058 | 0.0011 |
| Comp. ex. | — | — | — | — | <0.001 | — | — | — | — | — | — | 0.0037 | 0.0011 |
| Comp. ex. | — | — | — | — | <0.001 | — | — | — | — | — | — | 0.0051 | 0.0020 |
| Comp. ex. | — | — | — | — | <0.001 | — | — | — | — | — | — | 0.0028 | 0.0015 |
| Comp. ex. | — | — | — | — | <0.001 | — | — | — | — | — | — | 0.0034 | 0.0012 |
| Comp. ex. | — | — | — | — | <0.001 | — | — | — | — | — | — | 0.0037 | 0.0011 |
| Comp. ex. | — | — | — | — | <0.001 | — | — | — | — | — | — | 0.0024 | 0.0011 |
| Comp. ex. | — | — | — | — | <0.001 | — | — | — | — | — | — | 0.0033 | 0.0014 |
| Comp. ex. | — | — | — | — | <0.001 | — | — | — | — | — | — | 0.0036 | 0.0020 |
| Comp. ex. | — | — | — | — | <0.001 | — | — | — | — | — | — | 0.0042 | 0.0024 |
| Comp. ex. | — | — | — | — | <0.001 | — | — | — | — | — | — | 0.0054 | 0.0010 |
| Comp. ex. | — | — | — | — | <0.001 | — | — | — | — | — | — | 0.0026 | 0.0009 |
| Comp. ex. | — | — | — | — | <0.001 | — | — | — | — | — | — | 0.0042 | 0.0018 |
| Comp. ex. | — | — | — | — | <0.001 | — | — | — | — | — | — | 0.0025 | 0.0023 |
| Comp. ex. | — | — | — | — | <0.001 | — | — | — | — | — | — | 0.0026 | 0.0014 |

TABLE 10

| Ex. | No | Heat treatment method | Rolling heating temperature ° C. | Patenting heating temperature ° C. | Quenching heating temperature ° C. | Carbide poor region area ratio <5% | Carbide poor region area ratio <3% | Alloy-based cementite-based carbide occupancy ratio |
|---|---|---|---|---|---|---|---|---|
| Inv. ex. | 1 | B | 1220 | 950 | 1000 | 3.8 | 1.9 | 2.0 |
| Inv. ex. | 2 | A | 1220 | 950 | 950 | 0.1 | 2.2 | 2.6 |
| Inv. ex. | 3 | A | 1220 | 950 | 950 | 1.4 | 1.9 | 1.7 |
| Inv. ex. | 4 | A | 1220 | 950 | 950 | 0.3 | 1.5 | 1.6 |
| Inv. ex. | 5 | B | 1220 | 950 | 1000 | 2.4 | 2.0 | 2.0 |
| Inv. ex. | 6 | A | 1220 | 950 | 1000 | 4.6 | 0.8 | 0.2 |
| Inv. ex. | 7 | B | 1220 | 930 | 950 | 0.2 | 0.1 | 0.1 |
| Inv. ex. | 8 | B | 1220 | 950 | 950 | 2.4 | 2.1 | 0.1 |
| Inv. ex. | 9 | A | 1220 | 950 | 950 | 3.4 | 1.0 | 0.1 |
| Inv. ex. | 10 | A | 1220 | 950 | 950 | 3.8 | 2.7 | 2.8 |
| Inv. ex. | 11 | A | 1220 | 950 | 950 | 1.7 | 1.8 | 2.2 |
| Inv. ex. | 12 | A | 1220 | 950 | 950 | 1.7 | 0.5 | 0.9 |
| Inv. ex. | 13 | A | 1220 | 950 | 950 | 3.1 | 1.5 | 1.1 |
| Inv. ex. | 14 | A | 1220 | 950 | 950 | 3.6 | 1.6 | 2.3 |
| Inv. ex. | 15 | A | 1220 | 950 | 950 | 2.6 | 0.1 | 1.7 |
| Inv. ex. | 16 | A | 1220 | 950 | 950 | 4.2 | 0.7 | 2.4 |
| Inv. ex. | 17 | A | 1220 | 950 | 950 | 0.6 | 0.4 | 2.1 |
| Inv. ex. | 18 | A | 1220 | 930 | 950 | 1.2 | 1.8 | 0.5 |
| Inv. ex. | 19 | A | 1220 | 950 | 950 | 0.4 | 0.2 | 2.1 |
| Inv. ex. | 20 | A | 1220 | 950 | 950 | 0.3 | 2.2 | 2.7 |
| Inv. ex. | 21 | A | 1220 | 950 | 950 | 1.4 | 2.0 | 1.6 |
| Inv. ex. | 22 | A | 1220 | 950 | 950 | 4.7 | 1.2 | 2.4 |
| Inv. ex. | 23 | A | 1220 | 950 | 950 | 4.5 | 0.1 | 1.1 |
| Inv. ex. | 24 | A | 1220 | 950 | 950 | 3.1 | 1.1 | 1.3 |

| | Carbide presence density | | | | Tensile strength | HV after | Tensile test elongation | Rotational bending |
|---|---|---|---|---|---|---|---|---|
| Ex. | 0.2-3 μm | >3 μm | γ# | Residual γ % | MPa | annealing | % | MPa |
| Inv. ex. | 0.3 | <0.0001 | 13 | 5.2 | 2361 | 605 | 11.7 | 903 |
| Inv. ex. | 0.4 | <0.0001 | 11 | 10.7 | 2384 | 610 | 10.6 | 886 |
| Inv. ex. | 0.2 | <0.0001 | 12 | 8.5 | 2344 | 606 | 11.3 | 870 |
| Inv. ex. | 0.3 | <0.0001 | 11 | 9.7 | 2326 | 606 | 11.3 | 896 |
| Inv. ex. | 0.5 | <0.0001 | 13 | 6.0 | 2304 | 592 | 10.4 | 909 |
| Inv. ex. | 0.01 | <0.0001 | 13 | 3.4 | 2188 | 555 | 12.0 | 864 |
| Inv. ex. | 0.002 | <0.0001 | 13 | 4.2 | 2196 | 552 | 9.6 | 855 |
| Inv. ex. | 0.01 | <0.0001 | 12 | 5.6 | 2201 | 561 | 10.4 | 860 |
| Inv. ex. | 0.01 | <0.0001 | 12 | 4.4 | 2185 | 552 | 8.4 | 865 |
| Inv. ex. | 0.5 | <0.0001 | 11 | 7.8 | 2345 | 599 | 9.5 | 924 |
| Inv. ex. | 0.5 | <0.0001 | 11 | 7.7 | 2323 | 603 | 11.9 | 904 |
| Inv. ex. | 0.2 | <0.0001 | 10 | 7.3 | 2332 | 621 | 7.5 | 891 |
| Inv. ex. | 0.1 | <0.0001 | 12 | 9.7 | 2299 | 589 | 8.1 | 916 |
| Inv. ex. | 0.4 | <0.0001 | 11 | 8.6 | 2346 | 627 | 9.1 | 871 |
| Inv. ex. | 0.3 | <0.0001 | 13 | 7.8 | 2303 | 604 | 10.0 | 908 |
| Inv. ex. | 0.4 | <0.0001 | 13 | 11.6 | 2366 | 617 | 10.4 | 877 |
| Inv. ex. | 0.3 | <0.0001 | 12 | 12.0 | 2307 | 591 | 11.5 | 891 |
| Inv. ex. | 0.1 | <0.0001 | 13 | 7.9 | 2338 | 625 | 8.2 | 873 |
| Inv. ex. | 0.4 | <0.0001 | 13 | 11.3 | 2362 | 603 | 10.8 | 881 |
| Inv. ex. | 0.4 | <0.0001 | 12 | 8.1 | 2347 | 619 | 10.8 | 896 |
| Inv. ex. | 0.3 | <0.0001 | 12 | 11.8 | 2351 | 627 | 8.9 | 905 |
| Inv. ex. | 0.3 | <0.0001 | 13 | 11.2 | 2286 | 609 | 7.7 | 907 |
| Inv. ex. | 0.2 | <0.0001 | 10 | 7.8 | 2372 | 607 | 11.4 | 893 |
| Inv. ex. | 0.3 | <0.0001 | 12 | 8.5 | 2354 | 615 | 7.6 | 875 |

TABLE 11

| Example | No | Heat treatment method | Rolling heating temperature ° C. | Patenting heating temperature ° C. | Quenching heating temperature ° C. | Carbide poor region area ratio <5% | Carbide poor region area ratio <3% | Alloy-based cementite-based carbide occupancy ratio |
|---|---|---|---|---|---|---|---|---|
| Inv. ex. | 25 | A | 1220 | 950 | 950 | 0.5 | 0.2 | 1.9 |
| Inv. ex. | 26 | A | 1220 | 950 | 950 | 2.8 | 1.9 | 1.0 |
| Inv. ex. | 27 | A | 1220 | 950 | 950 | 2.7 | 2.2 | 1.9 |
| Inv. ex. | 28 | A | 1220 | 950 | 950 | 1.2 | 0.6 | 1.8 |
| Inv. ex. | 29 | B | 1220 | 950 | 1000 | 2.6 | 1.7 | 2.7 |

TABLE 11-continued

| | | | | | | | | |
|---|---|---|---|---|---|---|---|---|
| Inv. ex. | 30 | A | 1220 | 950 | 950 | 1.1 | 2.2 | 1.0 |
| Inv. ex. | 31 | A | 1220 | 950 | 950 | 4.3 | 1.6 | 0.4 |
| Inv. ex. | 32 | A | 1220 | 950 | 950 | 2.5 | 1.1 | 1.0 |
| Inv. ex. | 33 | A | 1220 | 950 | 950 | 1.2 | 1.5 | 1.3 |
| Inv. ex. | 34 | A | 1220 | 950 | 950 | 2.4 | 1.2 | 1.1 |
| Inv. ex. | 35 | B | 1220 | 950 | 1000 | 2.6 | 1.7 | 1.4 |
| Inv. ex. | 36 | B | 1220 | 950 | 1000 | 1.5 | 0.2 | 1.5 |
| Inv. ex. | 37 | B | 1220 | 950 | 1000 | 1.4 | 0.2 | 1.6 |
| Inv. ex. | 38 | A | 1220 | 950 | 950 | 1.5 | 1.4 | 1.6 |
| Inv. ex. | 39 | A | 1220 | 950 | 950 | 0.8 | 1.2 | 0.9 |
| Inv. ex. | 40 | A | 1220 | 950 | 950 | 4.0 | 2.5 | 1.8 |
| Inv. ex. | 41 | A | 1220 | 950 | 950 | 0.9 | 0.5 | 1.0 |
| Inv. ex. | 42 | A | 1220 | 950 | 950 | 0.3 | 0.5 | 0.6 |
| Inv. ex. | 43 | A | 1220 | 950 | 950 | 0.1 | 2.0 | 1.8 |
| Inv. ex. | 44 | A | 1220 | 950 | 950 | 2.2 | 1.1 | 2.7 |
| Inv. ex. | 45 | B | 1220 | 950 | 1000 | 4.1 | 1.1 | 1.3 |
| Inv. ex. | 46 | A | 1220 | 950 | 950 | 1.1 | 2.3 | 1.7 |
| Inv. ex. | 47 | A | 1220 | 950 | 950 | 0.3 | 1.1 | 0.7 |

| | Carbide presence density | | | | Tensile strength | HV after | Tensile test | Rotational bending |
|---|---|---|---|---|---|---|---|---|
| Example | 0.2-3 μm | >3 μm | γ# | Residual γ % | Mpa | annealing | elongation % | Mpa |
| Inv. ex. | 0.3 | <0.0001 | 13 | 10.6 | 2362 | 606 | 9.7 | 910 |
| Inv. ex. | 0.1 | <0.0001 | 10 | 9.8 | 2323 | 601 | 8.9 | 899 |
| Inv. ex. | 0.4 | <0.0001 | 11 | 7.6 | 2293 | 591 | 9.8 | 926 |
| Inv. ex. | 0.4 | <0.0001 | 12 | 12.2 | 2373 | 606 | 7.4 | 905 |
| Inv. ex. | 0.5 | <0.0001 | 13 | 6.3 | 2355 | 609 | 10.8 | 914 |
| Inv. ex. | 0.2 | <0.0001 | 12 | 10.3 | 2349 | 616 | 9.0 | 901 |
| Inv. ex. | 0.1 | <0.0001 | 13 | 10.7 | 2339 | 608 | 12.0 | 883 |
| Inv. ex. | 0.2 | <0.0001 | 13 | 7.6 | 2349 | 627 | 9.8 | 900 |
| Inv. ex. | 0.1 | <0.0001 | 10 | 9.3 | 2362 | 603 | 11.7 | 892 |
| Inv. ex. | 0.1 | <0.0001 | 12 | 10.7 | 2342 | 624 | 8.2 | 918 |
| Inv. ex. | 0.1 | <0.0001 | 13 | 3.4 | 2319 | 595 | 9.4 | 901 |
| Inv. ex. | 0.2 | <0.0001 | 12 | 4.3 | 2346 | 640 | 9.1 | 890 |
| Inv. ex. | 0.1 | <0.0001 | 12 | 7.7 | 2354 | 618 | 11.5 | 897 |
| Inv. ex. | 0.3 | <0.0001 | 11 | 11.5 | 2367 | 611 | 7.5 | 900 |
| Inv. ex. | 0.1 | <0.0001 | 10 | 11.5 | 2336 | 595 | 10.0 | 911 |
| Inv. ex. | 0.2 | <0.0001 | 12 | 11.1 | 2315 | 599 | 9.0 | 909 |
| Inv. ex. | 0.1 | <0.0001 | 12 | 9.4 | 2355 | 613 | 8.6 | 874 |
| Inv. ex. | 0.0 | <0.0001 | 11 | 9.6 | 2316 | 593 | 11.2 | 897 |
| Inv. ex. | 0.2 | <0.0001 | 10 | 7.7 | 2351 | 630 | 10.2 | 891 |
| Inv. ex. | 0.5 | <0.0001 | 11 | 7.9 | 2298 | 590 | 8.1 | 900 |
| Inv. ex. | 0.2 | <0.0001 | 12 | 5.1 | 2366 | 605 | 9.0 | 895 |
| Inv. ex. | 0.2 | <0.0001 | 10 | 10.4 | 2326 | 594 | 10.9 | 920 |
| Inv. ex. | 0.1 | <0.0001 | 13 | 8.1 | 2297 | 613 | 12.2 | 892 |

TABLE 12

| Ex. | No | Heat treatment method | Rolling heating temperature ° C. | Patenting heating temperature ° C. | Quenching heating temperature ° C. | Carbide poor region area ratio <5% | Carbide poor region area ratio <3% | Alloy-based cementite-based carbide occupancy rate |
|---|---|---|---|---|---|---|---|---|
| Comp. ex. | 48 | A | 1220 | 950 | 950 | 0.8 | 0.4 | 0.2 |
| Comp. ex. | 49 | A | 1220 | 950 | 950 | 1.7 | 0.7 | 0.6 |
| Comp. ex. | 50 | A | 1220 | 950 | 880 | 2.1 | 0.9 | 8.2 |
| Comp. ex. | 51 | A | 1220 | 950 | 880 | 6.2 | 3.7 | 7.5 |
| Comp. ex. | 52 | A | 1220 | 950 | 950 | 1.1 | 0.7 | 2.4 |
| Comp. ex. | 53 | A | 1220 | 950 | 950 | 0.8 | 1.3 | 6.6 |
| Comp. ex. | 54 | A | 1220 | 950 | 950 | 1.5 | 1.1 | 12.1 |
| Comp. ex. | 55 | A | 1220 | 950 | 950 | 7.9 | 4.2 | 4.7 |
| Comp. ex. | 56 | A | 1220 | 950 | 950 | 5.7 | 3.6 | 6.4 |
| Comp. ex. | 57 | A | 1220 | 950 | 950 | 3.9 | 2.1 | 7.5 |
| Comp. ex. | 58 | A | 1220 | 950 | 950 | 7.0 | 3.9 | 9.4 |
| Comp. ex. | 59 | A | 1220 | 950 | 950 | 8.3 | 5.1 | 13.6 |
| Comp. ex. | 60 | A | 1220 | 950 | 1020 | 7.3 | 4.5 | 0.9 |
| Comp. ex. | 61 | A | 1050 | 950 | 950 | 10.2 | 6.1 | 1.5 |
| Comp. ex. | 62 | A | 1050 | 950 | 950 | 9.7 | 4.9 | 1.3 |
| Comp. ex. | 63 | A | 1050 | 950 | 950 | 10.0 | 5.8 | 1.3 |
| Comp. ex. | 64 | A | 1050 | 950 | 950 | 7.0 | 3.7 | 1.3 |
| Comp. ex. | 65 | A | 1050 | 950 | 950 | 6.5 | 4.5 | 0.6 |
| Comp. ex. | 66 | B | 1050 | 950 | 1000 | 6.1 | 4.4 | 1.3 |
| Comp. ex. | 67 | A | 1050 | 950 | 950 | 9.4 | 5.3 | 1.4 |
| Comp. ex. | 68 | B | 1220 | 890 | 1000 | 9.7 | 5.5 | 5.3 |
| Comp. ex. | 69 | A | 1220 | 890 | 950 | 10.1 | 5.7 | 1.3 |

TABLE 12-continued

| | | | | | | | | |
|---|---|---|---|---|---|---|---|---|
| Comp. ex. | 70 | A | 1220 | 950 | 950 | 0.0 | 0.7 | 1.5 |
| Comp. ex. | 71 | A | 1220 | 950 | 950 | 1.1 | 0.8 | 0.5 |
| Comp. ex. | 72 | A | 1220 | 950 | 950 | 8.4 | 4.5 | 2.0 |
| Comp. ex. | 73 | A | 1220 | 950 | 950 | 1.0 | 0.7 | 0.8 |
| Comp. ex. | 74 | A | 1220 | 950 | 1000 | 2.5 | 0.5 | 1.2 |
| Comp. ex. | 75 | A | 1220 | 950 | 1000 | 7.3 | 3.8 | 1.0 |
| Comp. ex. | 76 | A | 1220 | 950 | 1000 | 2.0 | 0.1 | 1.6 |
| Comp. ex. | 77 | A | 1220 | 950 | 1000 | 5.9 | 3.2 | 1.1 |
| Comp. ex. | 78 | A | 1220 | 950 | 950 | 1.3 | 0.3 | 0.3 |
| Comp. ex. | 79 | A | 1220 | 950 | 950 | 2.8 | 0.9 | 1.4 |

| | Carbide presence density | | | | Tensile strength | HV after | Tensile test | Rotational bending |
|---|---|---|---|---|---|---|---|---|
| Ex. | 0.2-3 μm | >3 μm | γ# | Residual γ % | Mpa | annealing | elongation % | Mpa |
| Comp. ex. | <0.1 | <0.0001 | 13 | 7.2 | 1967 | 523 | 10.9 | 844 |
| Comp. ex. | <0.1 | <0.0001 | 13 | 7.3 | 1915 | 488 | 12.5 | 836 |
| Comp. ex. | 1.3 | <0.0001 | 13 | 9.9 | 2240 | 585 | 1.3 | 901 |
| Comp. ex. | 1.6 | <0.0001 | 13 | 11.6 | 2232 | 571 | 5.1 | 870 |
| Comp. ex. | 0.3 | 0.034 | 11 | 9.6 | 2348 | 631 | 4.4 | 880 |
| Comp. ex. | 1.3 | <0.0001 | 11 | 11.8 | 2256 | 602 | 4.7 | 881 |
| Comp. ex. | 2.6 | <0.0001 | 10 | 11.3 | 2273 | 584 | 5.3 | 882 |
| Comp. ex. | 1.2 | <0.0001 | 12 | 8.8 | 2368 | 616 | 5.3 | 894 |
| Comp. ex. | 1.3 | <0.0001 | 12 | 8.7 | 2310 | 619 | 1.6 | 883 |
| Comp. ex. | 1.5 | <0.0001 | 11 | 8.3 | 2280 | 587 | 7.5 | 843 |
| Comp. ex. | 2.1 | <0.0001 | 11 | 7.7 | 2288 | 611 | 5.4 | 897 |
| Comp. ex. | 2.9 | <0.0001 | 13 | 18.3 | 2314 | 592 | 4.6 | 912 |
| Comp. ex. | 0.1 | <0.0001 | 9 | 8.5 | 2298 | 591 | 2.4 | 876 |
| Comp. ex. | 0.2 | <0.0001 | 11 | 9.6 | 2307 | 605 | 5.0 | 900 |
| Comp. ex. | 0.2 | <0.0001 | 11 | 16.4 | 2304 | 608 | 4.6 | 897 |
| Comp. ex. | 0.3 | <0.0001 | 10 | 8.7 | 2254 | 597 | 4.5 | 896 |
| Comp. ex. | 1.7 | <0.0001 | 11 | 10.7 | 2277 | 569 | 8.8 | 842 |
| Comp. ex. | 1.8 | <0.0001 | 11 | 11.3 | 2305 | 566 | 12.0 | 822 |
| Comp. ex. | 0.8 | <0.0001 | 12 | 8.2 | 2268 | 593 | 2.2 | 878 |
| Comp. ex. | 0.2 | <0.0001 | 12 | 9.1 | 2330 | 617 | 4.6 | 876 |
| Comp. ex. | 2.7 | <0.0001 | 11 | 9.1 | 2276 | 594 | 1.3 | 889 |
| Comp. ex. | 0.3 | <0.0001 | 10 | 7.6 | 2297 | 600 | 5.7 | 881 |
| Comp. ex. | 0.1 | <0.0001 | 11 | 10.4 | 2054 | 509 | 9.6 | 725 |
| Comp. ex. | 0.0 | <0.0001 | 12 | 18.9 | 2274 | 554 | 5.3 | 864 |
| Comp. ex. | 0.3 | <0.0001 | 11 | 18.6 | 2305 | 540 | 7.8 | 867 |
| Comp. ex. | 0.2 | <0.0001 | 12 | 17.6 | 2145 | 533 | 9.8 | 764 |
| Comp. ex. | <0.1 | <0.0001 | 8 | 7.7 | 2263 | 579 | 1.0 | 910 |
| Comp. ex. | 0.2 | <0.0001 | 8 | 11.8 | 2302 | 615 | 4.8 | 882 |
| Comp. ex. | 0.3 | <0.0001 | 8 | 10.5 | 2300 | 596 | 5.3 | 890 |
| Comp. ex. | 0.1 | <0.0001 | 8 | 10.0 | 2299 | 599 | 3.5 | 875 |
| Comp. ex. | 0.0 | <0.0001 | 11 | 8.0 | 2252 | 543 | 9.4 | 794 |
| Comp. ex. | 0.3 | <0.0001 | 11 | 11.5 | 2298 | 552 | 7.4 | 813 |

INDUSTRIAL APPLICABILITY

The present invention steel controls the spherical carbide containing cementite, hard oxides, and sulfides in the steel wire for cold coiling spring so as to increase the strength to 2000 MPa or more and reduces the occupied area ratio and density of presence of the spherical carbide including cementite and the austenite grain size and amount of residual austenite in the spring steel wire so as to increase the strength to 2000 MPa or more and secure coilability so as to enable the production of a spring high in strength and superior in breakage characteristics.

The invention claimed is:

1. Heat treated steel wire used for a spring steel containing, by mass %,

C: 0.45 to 0.70%,

Si: 1.0 to 3.0%,

Mn: 0.1 to 2.0%,

P: 0.015% or less,

S: 0.015% or less,

Zr: 0.0001 to 0.0005%

N: 0.0005 to 0.007%,

Cr: 1.16 to 2.5%, and t-O: 0.0002 to 0.01%, having a balance of Fe and unavoidable impurities, and further satisfies Al≤0.01% and Ti≤0.003%, which is rolled, drawn, and heat treated, wherein said steel wire is characterized in that, with respect to cementite-based spherical carbides and alloy-based carbides on an observed plane, the percentage of an area occupied by carbides having a circle equivalent diameter of 0.2 μm or more is 7% or less, the density of carbides having a circle equivalent diameter of 0.2 to 3 μm is 1 /$\mu m^2$ or less, the density of carbides having a circle equivalent diameter of 3 μm or more is 0.001/$\mu m^2$ or less, the grain size number of a prior austenite is #10 or higher and the amount of a residual austenite is 15 mass % or less, and the area ratio of a cementite-based carbide density poor region is 3% or less, and wherein the cementite-based carbide density poor region is a region that has a circle equivalent diameter of 2 μm or more wherein the occupied area ratio of cementite-based carbides in a corroded and recessed region of a microstructure is 60% or less.

2. Heat treated steel wire used for a spring steel as set forth in claim 1, said heat treated steel wire characterized by further containing, by mass %, one or more of W: 0.05 to 1.0%, Mo: 0.05 to 1.0%, V: 0.05 to 1.0%, Nb: 0.01 to 0.05%, Ni: 0.05 to 3.0%, Co: 0. 05 to 3.0%, B: 0.0005 to 0.006%, Cu: 0.05 to 0.5%, Mg: 0.0002 to 0.01%, Ca: 0.0002 to 0.01%, Hf: 0.0002 to 0.01%, Te: 0.0002 to 0.01%, and Sb: 0.0002 to 0.01%.

3. Heat treated steel wire used for a spring steel containing, by mass %,

C: 0.45 to 0.70%,
Si: 1.0 to 3.0%,
P: 0.015% or less,
S: 0.015% or less,
Zr: 0.0001 to 0.0005%
N: 0.0005 to 0.007%,
Cr: 1.16 to 2.5%, and
t-O: 0.0002 to 0.01%, having a balance of Fe and unavoidable impurities, and further satisfies Al≤0.01% and Ti≤0.003%, which is rolled, drawn, and heat treated, wherein said steel wire is characterized in that, with respect to cementite-based spherical carbides and alloy-based carbides on an observed plane, the percentage of an area occupied by carbides having a circle equivalent diameter of 0.2 μm or more is 7% or less, the density of carbides having a circle equivalent diameter of 0.2 to 3 μm is $1/\mu m_2$ or less, the density of carbides having a circle equivalent diameter of 3 μm or more is $0.001/\mu m^2$ or less, the grain size number of a prior austenite is #10 or higher and the amount of a residual austenite is 15 mass % or less, and the area ratio of a cementite-based carbide density poor region is 3% or less, and wherein the cementite-based carbide density poor region is a region that has a circle equivalent diameter of 2 μm or more wherein the occupied area ratio of cementite-based carbides in a corroded and recessed region of a microstructure is 60% or less, wherein the steel of said heat treated steel wire has a uniform tempered martensite microstructure.

4. Heat treated steel wire used for a spring steel as set forth in claim 1, said heat treated steel wire characterized by containing, by mass %, Zr: 0.0003% or less.

5. Heat treated steel wire used for a spring steel as set forth in claim 1, said heat treated steel wire characterized by containing, by mass %, Si: 1.6 to 3.0%.

6. Heat treated steel wire used for a spring steel as set forth in claim 1, said heat treated steel wire characterized by containing, by mass %, Cr: 1.7 to 2.5%.

7. Heat treated steel wire used for a spring steel as set forth in claim 3, said heat treated steel wire characterized by containing, by mass %, Si: 1.6 to 3.0%.

8. Heat treated steel wire used for a spring steel as set forth in claim 3, said heat treated steel wire characterized by containing, by mass %, Cr: 1.7 to 2.5%.

* * * * *